US009015909B2

(12) United States Patent
Daijogo

(10) Patent No.: US 9,015,909 B2
(45) Date of Patent: Apr. 28, 2015

(54) SLIDE FASTENER

(75) Inventor: Shinichi Daijogo, Toyama (JP)

(73) Assignee: YKK Corporation (JP)

( * ) Notice: Subject to any disclaimer, the term of this patent is extended or adjusted under 35 U.S.C. 154(b) by 478 days.

(21) Appl. No.: 13/382,540

(22) PCT Filed: Jul. 7, 2009

(86) PCT No.: PCT/JP2009/062387

§ 371 (c)(1),
(2), (4) Date: Jan. 6, 2012

(87) PCT Pub. No.: WO2011/004462

PCT Pub. Date: Jan. 13, 2011

(65) Prior Publication Data

US 2012/0110795 A1 May 10, 2012

(51) Int. Cl.

| | |
|---|---|
| ***A44B 19/24*** | (2006.01) |
| ***A44B 19/10*** | (2006.01) |
| ***A44B 19/08*** | (2006.01) |
| ***A44B 19/12*** | (2006.01) |

(52) U.S. Cl.

CPC ..... *A44B 19/08* (2013.01); *Y10T 24/252* (2015.01); *Y10T 24/2557* (2015.01); *A44B 19/12* (2013.01)

(58) Field of Classification Search

CPC ..... A44B 19/54; A44B 19/12; A44B 19/406; A44B 19/403; A44B 19/04

USPC ..... 24/392, 394, 396, 413

See application file for complete search history.

(56) References Cited

U.S. PATENT DOCUMENTS

| | | | | | |
|---|---|---|---|---|---|
| 3,057,031 | A | * | 10/1962 | Wahl | 24/396 |
| 3,103,728 | A | * | 9/1963 | Wahl | 24/397 |
| 3,430,304 | A | * | 3/1969 | Swainson | 24/394 |
| 3,456,306 | A | * | 7/1969 | Heimberger | 24/397 |
| 3,524,479 | A | * | 8/1970 | Burbank | 139/384 R |
| 3,613,180 | A | * | 10/1971 | Burbank | 24/391 |
| 3,665,561 | A | * | 5/1972 | Heimberger | 24/396 |
| 3,665,879 | A | * | 5/1972 | Sohr | 29/410 |
| 3,783,476 | A | * | 1/1974 | Frohlich | 24/394 |
| 3,789,465 | A | * | 2/1974 | Moertel | 24/395 |

(Continued)

FOREIGN PATENT DOCUMENTS

| | | | |
|---|---|---|---|
| DE | 2546958 | A | 5/1976 |
| DE | 68912753 | C | 6/1994 |

(Continued)

OTHER PUBLICATIONS

International Search Report, PCT Application No. PCT/JP09/062387, mailed Oct. 13, 2009.

*Primary Examiner* — Victor Batson
*Assistant Examiner* — Jason W San
(74) *Attorney, Agent, or Firm* — Kilpatrick Townsend & Stockton LLP

(57) ABSTRACT

A separation portion having weakened tensile rupture strength of an element having tensile rupture strength reduced to 40 N or below is formed in a range of a first fixing portion of a first leg portion to a second fixing portion of a second leg portion via a coupling head portion, in at least a part of elements of the slide fastener. With this arrangement, when excessive lateral pulling force is applied to the slide fastener, cleavage lateral pulling force that causes cleavage of the slide fastener can be reduced. By adjusting tensile rupture strength of the elements, cleavage lateral pulling force of the slide fastener can be set within a predetermined range.

3 Claims, 14 Drawing Sheets

(56) References Cited

U.S. PATENT DOCUMENTS

| | | | | | |
|---|---|---|---|---|---|
| 3,820,202 | A | * | 6/1974 | Stephenson | 24/393 |
| 3,849,842 | A | * | 11/1974 | Yoshida | 24/393 |
| 4,000,545 | A | | 1/1977 | Takamatsu | |
| 4,034,444 | A | * | 7/1977 | Moertel | 24/394 |
| 4,058,145 | A | * | 11/1977 | Frohlich et al. | 139/384 B |
| 4,126,158 | A | * | 11/1978 | Scott | 139/384 B |
| 4,133,084 | A | * | 1/1979 | Yoshida | 24/393 |
| 4,623,004 | A | * | 11/1986 | Matsushima et al. | 139/384 B |
| 4,639,981 | A | * | 2/1987 | Yoshida et al. | 24/401 |
| 4,989,300 | A | * | 2/1991 | Fukuroi | 24/391 |
| 5,058,246 | A | * | 10/1991 | Fujisaki et al. | 24/394 |
| 5,142,747 | A | * | 9/1992 | Matsushima | 24/391 |
| 5,167,051 | A | * | 12/1992 | Kousaka | 24/391 |
| 5,511,292 | A | * | 4/1996 | Covi et al. | 24/410 |
| 5,528,801 | A | * | 6/1996 | Hasegawa | 24/403 |
| 6,505,652 | B1 | * | 1/2003 | Matsushima | 139/384 B |
| 6,651,296 | B2 | * | 11/2003 | Matsuda | 24/397 |
| 7,137,177 | B2 | * | 11/2006 | Fujii et al. | 24/433 |
| 7,416,397 | B2 | * | 8/2008 | Kusayama et al. | 425/116 |
| 7,520,304 | B2 | * | 4/2009 | Shimono et al. | 139/384 B |
| 8,015,674 | B2 | * | 9/2011 | Matsui et al. | 24/413 |
| 8,151,418 | B2 | * | 4/2012 | Nakayama et al. | 24/392 |
| 8,572,816 | B2 | * | 11/2013 | Dono et al. | 24/413 |
| 2008/0110211 | A1 | * | 5/2008 | Shimono et al. | 66/193 |

FOREIGN PATENT DOCUMENTS

| | | | |
|---|---|---|---|
| GB | 1514296 | A | 6/1978 |
| JP | 51-47843 | A | 4/1976 |
| JP | 2-177902 | A | 7/1990 |
| JP | 2006-15158 | A | 1/2006 |
| JP | 2009/28131 | A | 2/2009 |
| JP | 2009-160268 | A | 7/2009 |
| WO | 2009/014094 | A1 | 1/2009 |
| WO | 2009/087851 | A1 | 7/2009 |

* cited by examiner

SLIDE FASTENER

TECHNICAL FIELD

The invention relates to a slide fastener that has predetermined resistance of lateral pulling force and that cleaves a coupled state of elements when predetermined cleavage lateral pulling force is applied.

BACKGROUND ART

In recent years, a side airbag that protects a head portion of a passenger when the vehicle collides is installed at the side of a seatback or inside roof above doors of vehicle. This side airbag apparatus has an inflator that generates an expansion gas after the vehicle collides and receives a large impact, and an airbag that is expanded by inflation when the gas is supplied from the inflator. In a state that the airbag is accommodated before the side airbag apparatus works, the airbag is accommodated at the side of the seatback of the vehicle seat, for example, by being folded in a predetermined procedure, and the side airbag apparatus itself is covered by a seat cover and the like.

Usually, a seat cover such as a fabric and a leather to cover a cushion member of a seat is covered on a front surface of a vehicle seat. An expansion opening for expanding the airbag is formed in the seat cover at the side of the seatback where the side airbag apparatus is installed. Conventionally, this expansion opening is sewed by a fragile sewing thread that is disconnected when the expansion opening is pulled with predetermined force.

When a vehicle collides and receives a large impact, this side airbag apparatus senses this impact, generates a high-pressure gas from the inflator, introduces the gas into the airbag, and momentarily expands the airbag. When the airbag is expanded, excessively large tensile force is applied to the sewing thread that is used to sew the expansion opening. Therefore, the sewing thread is disconnected by this tensile force, and the expansion opening so far closed is opened and the airbag is expanded from this opening. This airbag is expanded to the side of a passenger, and supports the head portion, the breast portion, and the lumber portion of the passenger by buffering. With this arrangement, impact strength applied to a human body at a collision time can be substantially alleviated, and safety of the passenger can be secured.

However, when a structure to close the expansion opening of the airbag with the sewing thread is employed, a seat cover needs to be covered on the seat after the airbag apparatus is installed on the seat, and this generates inconvenience that a manufacturing process is limited. Many recent vehicle seats are installed with various auxiliary apparatuses such as a heater and an actuator for adjusting a seat height, and a degree of freedom in the manufacturing process is desired. Further, conventionally, when inspection of the airbag apparatus is necessary after delivery of a vehicle, the airbag apparatus cannot be inspected without removing the seat cover, and this makes a work process complex.

Further, there is inconvenience that rupture strength of a sewing thread greatly changes depending on a sewing state, and also greatly changes depending on a temperature increase in a vehicle chamber and ageing. When the sewing thread is not easily disconnected, serious inconvenience occurs that the airbag does not expand at an emergency time. When strength of the sewing thread is small, and also when strong tensile force works on the seat cover when a passenger is seated, the sewing thread is ruptured, the expansion opening is cleaved, and the seat cushion is exposed.

When the airbag is expanded, each sewing thread is sequentially ruptured. Therefore, an expansion speed of the airbag decreases.

In place of the structure of closing the expansion opening by using a sewing thread having various kinds of inconvenience as described above, a closing structure of the expansion opening that uses a slide fastener is calling attention. The slide fastener can freely open and close the expansion opening by sliding a slider even after the slide fastener is sewed to the seat cover. Therefore, a seat having a complex structure can be easily assembled by increasing a degree of freedom of the assembling process. When inspecting the airbag apparatus, wiring and an attaching portion can be easily inspected by opening and closing the slide fastener.

When a coupling between elements is disengaged at a part of the slide fastener where the elements are coupled, and when lateral pulling force is continuously applied in this state, a coupling between elements of rows of elements can be disengaged with weak force without moving the slide fastener, starting from a portion where the coupling is disengaged. Therefore, a cleave speed becomes fast, unlike a speed when sewing threads are sequentially ruptured. Consequently, development of expansion of the airbag can be performed quickly, and a passenger can be effectively protected. Particularly, because a distance between a head portion of a passenger and a side glass of a vehicle is configured small, the side airbag needs to be expanded in a short time after a collision.

Patent Document 1 (Japanese Patent Application Laid-Open No. 2006-15158), for example, discloses a slide fastener that has an emergency opening unit having an easy cleave structure to be used for an expansion opening of an airbag.

The slide fastener having an emergency opening unit disclosed in Patent Document 1 uses an insert-molding method for fixing elements to an element-attached portion of a fastener tape simultaneously with formation of the elements. Each element of the slide fastener has two leg portions that are fixed to stride the element-attached portion of an edge portion of the fastener tape, a body portion that connects the two leg portions, a coupling head portion that is formed at an external end portion to couple a pair of elements at left and right sides in a lateral pulling direction, and a neck portion that connects between the coupling head portion and the body portion. A trench is formed along a coupling axis line at a crest portion of the coupling head portion. A shoulder portion to be engaged with the trench is formed to bulge from the body portion and the neck portion at a center portion of the elements in a width direction.

The coupling head portions are engaged with neck portions of two adjacent elements fixed to the other fastener tape of oppositely arranged fastener tapes, to prevent cleavage of the coupled elements in a lateral pulling direction, by lateral pulling force equal to or smaller than predetermined cleavage lateral pulling force that cleaves the coupled state of the elements. The shoulder portion that is formed to bulge is configured to be engaged with the trench provided in the opposite coupling head portion. Therefore, the shoulder portion prevents disengagement of left and right fastener stringers by being deviated to a shearing direction.

Further, according to the slide fastener described in Patent Document 1, back-surface sides of the coupling head portions engaged with the shoulder portions of the elements are disconnected. Therefore, two elements having front-and-back asymmetrical coupling head portions are arranged at the center portion of the slide fastener. This portion is easily cleaved with force pushed up from the back-surface side of the slide fastener, and becomes a cleavage start point of the slide fastener when expanding the airbag.

CITATION LIST

Patent Document

Patent Document 1: Japanese Patent Application Laid-Open No. 2006-15158

SUMMARY OF THE INVENTION

Problems to be Solved by the Invention

The slide fastener having an emergency opening unit described in Patent Document 1 has a cleavage start point formed at the center of the slide fastener to facilitate disengagement of the elements that are coupled with each other, when force pushing up from the back surface side is applied based on expansion and the like of the airbag. When the airbag is expanded, first, the coupling is disengaged at the cleavage start point having the front-and-back asymmetrical coupling head portions. Thereafter, following the expansion of the airbag, the coupling is sequentially disengaged toward the end portion of the slide fastener.

Although the slide fastener includes various advantage to close the expansion opening of the airbag as described above, the slide fastener that has a cleavage start point at a part of the slide fastener having a configuration as described in Patent Document 1 cannot be cleaved when the coupling is not disengaged at the portion of the cleavage start point. Therefore, the cleavage does not become stable, and it takes time for the cleavage.

According to a shape of the elements described in Patent Document 1, when excessive lateral pulling force is applied due to some factor, cleavage occurs at the neck portions of the elements or at a thin portion of leg portions, and the coupling head portions of the elements has a risk of being separated from the fastener tape.

Because the slide fastener described in Patent Document 1 is configured such that the elements of the slide fastener are directly visible from the front, when the slide fastener is used to close the expansion opening of a seat cover of a vehicle, a cover such as a flap to hide the slide fastener needs to be separately attached. When a cover is attached to the front surface of the slide fastener, presence of the slide fastener at this position becomes noticeable, and this has inconvenience that a junction portion of a cloth fabric is visible from appearance.

The invention has been achieved in view of the above conventional problems, and the invention has an object of providing a slide fastener that more clearly starts cleavage when predetermined lateral pulling force is applied and that does not cause disfigurement.

Means for Solving the Problems

To achieve the above object, a slide fastener according to the invention has the following characteristic. The slide fastener is attached to an element-attached portion, which is an opposite side edge portion of each fastener tape of a pair of a first fastener stringer and a second fastener stringer at left and right sides. A plurality of elements is formed with first and second leg portions that are extended from a coupling head portion which couples each other and the coupling head portion of an element-attached portion of each fastener stringer. The first and second leg portions of each element are fixed at the element-attached portion by a plural number along a tape length direction by using a fixing thread to form a first fixing portion and a second fixing portion. In at least a part of elements of the plural elements, a separation portion in which a part of the first or the second leg portions is separated in advance is formed in a range of from the first fixing portion of the first leg portion to the second fixing portion of the second leg portion via the coupling head portion.

Preferably, the separation portion has a cross-sectional area reduced to 0.1 $mm^2$ or below. Further, a configuration of a part of the elements in the separation portion can be separated in advance.

Preferably, the separation portion is formed in a range of the first or second fixing portion to the coupling head portion.

Preferably, a curved edge is formed by folding inside in a U shape at a coupled side of the first and second fastener stringers, and the element is fixed to one element-attached portion that is folded in a U shape such that the coupling head portion of the element is stretched outward.

Preferably, the plural elements that are adjacent to each other are connected together by a connecting thread at the first and second leg portions.

Preferably, the plural elements are elements in a continuous coil shape or zigzag shape, and are connected at a connecting portion of end portions of the first and second leg portions.

Effects of the Invention

According to the invention, in at least a part of elements of plural elements that are fixed to element-attached portions of a pair of a first fastener stringer and a second fastener stringer at left and right sides, a separation portion that has weakened tensile rupture strength of an element which is reduced to 40N or below, including a separation portion in which a part of the first or the second leg portion is separated in advance is formed in a range of the first fixing portion of the first leg portion to the second fixing portion of the second leg portion via the coupling head portion. Therefore, when lateral pulling force applied to the first and second fastener stringers in a coupled state is increased, cleavage starts at a separation portion that is formed in the elements, when the lateral pulling force exceeds predetermined cleavage lateral pulling force. Then, leg portions of the elements are bent and deformed, and cannot maintain the coupled state. When force equal to or larger than the predetermined cleavage lateral pulling force works on the coupled portion by the lateral pulling force applied to the pair of fastener stringers at left and right sides, the elements are sequentially disengaged from the separation portion where the coupled state becomes weak, and the first and second fastener stringers become in a separated state.

When a cross-sectional area of the separation portion is reduced to 0.1 $mm^2$ or below or when a part of the first or the second leg portion is separated in advance at a separation portion, cleavage can be securely performed when the slide fastener is used for the expansion opening of an airbag and a life jacket. When a cross-sectional area is set to 0 $mm^2$ and also when a configuration of a part of elements of the separation portion is separated, the separation portion can be easily processed by a slit processing machine or the like, and quality management becomes easy.

When the separation portion is formed in a range of a first or second fixing portion to a coupling head portion of an element, formation of the separation portion after the first and second stringers are fixed to the elements becomes easy.

Because plural adjacent elements are directly connected together at a front edge connecting portion of the first and second leg portions, the elements become stable. Therefore, processing of the separation portion after the elements are fixed to the first and second fastener stringers becomes easy.

By forming the elements as elements in a continuous coil shape or zigzag shape, the first and second leg portions of respective elements can be connected together. With this arrangement, fixing of the elements to the first and second fastener stringers and processing of the separation portion after the elements are fixed can be easily performed.

BEST MODES FOR CARRYING OUT THE INVENTION

Figure 1:
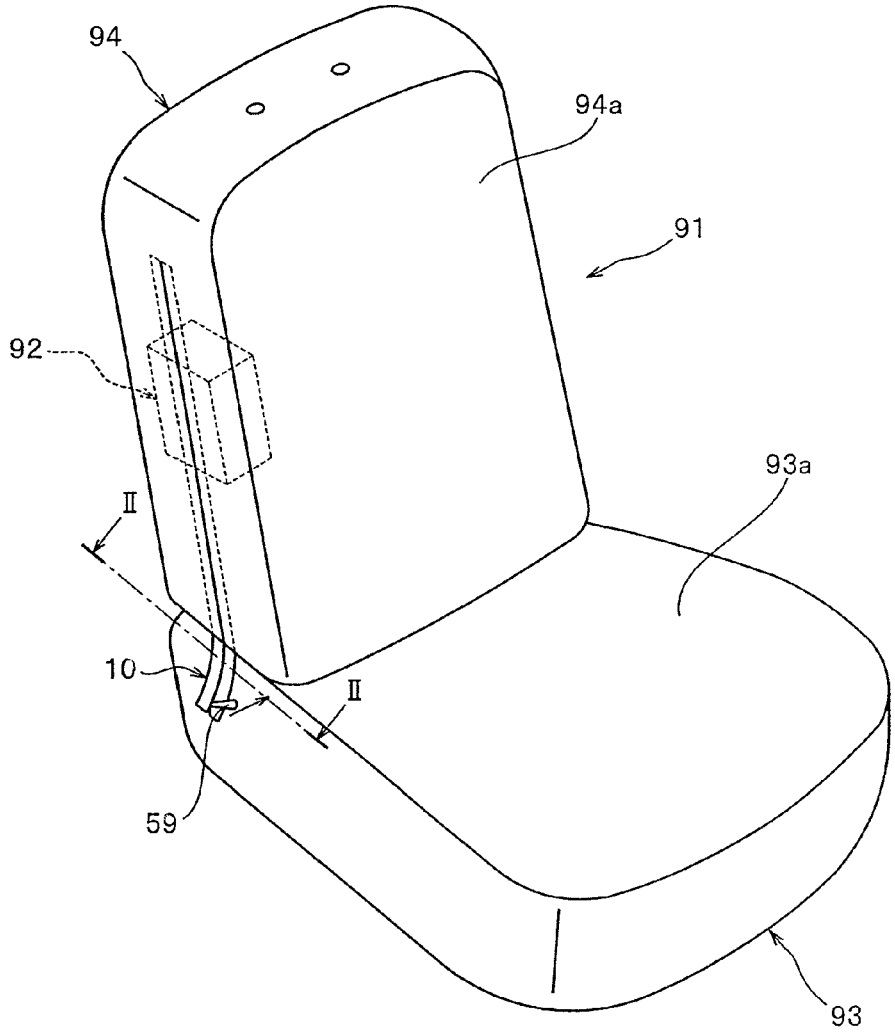
FIG. 1 shows an example of use that a slide fastener according to the invention is applied to the side of a seatback of a vehicle seat.

Representative modes of embodiments of elements and a slide fastener using these elements according to the invention are explained in detail below with reference to drawings. FIG. 1 shows an example of use that a slide fastener according to the invention is applied to the side of a seatback of a vehicle seat.

The slide fastener according to the invention can be used for a seat-cover opening portion of a vehicle seat 91 in which a side airbag apparatus 92 is installed, for example. The vehicle seat 91 shown in FIG. 1 has a seat cushion 93 that forms a seat, and a seatback 94 that forms a backrest portion. A seat frame that forms a total shape of the vehicle seat 91, a seat spring that receives pressure by averaging load when a passenger is seated on the vehicle seat 91, and a cushion member that forms a foamed synthetic resin of a predetermined shape are held in the seat cushion 93 and the seatback 94. A front surface of the cushion member is covered by seat covers 93*a*, 94*a* such as a fabric and a leather.

At the side of the seatback 94, the side airbag apparatus 92 is incorporated that substantially alleviates an impact applied to the side of the head portion of a passenger, by developing a side airbag to the side of the passenger when a vehicle receives a large impact due to a collision. An expansion opening of the side airbag apparatus 92 is closed by a slide fastener 10. An actuator and its operating mechanisms for adjusting a seat height, a heater for heating the seat surface, and other auxiliary machines are also installed in addition to the side airbag apparatus 92, in some of the vehicle seats 91.

The seat cover 94*a* is covered on the backrest portion after the side airbag apparatus 92 and other auxiliary machines are assembled, and closes the expansion opening of the side airbag apparatus 92 by sliding a slider of the slide fastener 10. When a hidden slide fastener on which rows of elements are arranged at a front surface side is used for the slide fastener 10, the slide fastener can be set invisible from the side of the seat back 94, and the side of the seatback 94 looks good.

In the state shown in FIG. 1, the slide fastener 10 having a large length is used such that an end (a portion where a tab 59 of a slider is visible) of the slide fastener 10 in a coupled state on a whole surface is extended from a lower end portion (an end portion at a seat cushion 93 side) of the seat cover 94*a*. In an embodiment shown in FIG. 1, after the slide fastener 10 is closed by sliding the slider, the end of the slide fastener 10 is hidden by folding back the end to the inside covered by the seat cover 94*a*, and the tab 59 of the slide fastener 10 is set invisible from the outside.

When a passenger is seated on the vehicle seat 91, a center portion of the backrest of the seatback 94 is recessed based on load. Therefore, lateral pulling force is applied to the slide fastener 10 that covers the side of the seatback 94. The slide fastener 10 is necessary to have a capacity that can sufficiently bear the lateral pulling force applied at a usual using time. On the other hand, when the vehicle collides, the airbag must be expanded by cleaving the slide fastener 10.

Therefore, the slide fastener 10 needs to sufficiently bear lateral pulling force of about 150 N/inch (5.9 N/mm) that is usually applied and also needs to expand the airbag by cleaving the slide fastener within $^{20}/_{1000}$ seconds when lateral pulling force of 240 N/inch to 500 N/inch (9.44 N/mm to 19.7 N/mm) is applied. In general, there are many cases where lateral pulling strength of a slide fastener product is expressed by tensile strength per one inch of a slide fastener. Therefore, in the present application, lateral pulling strength is also expressed by mainly using this tensile strength per one inch (N/inch). When lateral pulling strength is converted to an MKS unit system, the lateral pulling strength can be expressed by 1 N/inch=$^{1}/_{25.4}$ N/mm.

To satisfy this requirement, in the invention, a separation portion in which a part of the first or the second leg portion is separated in advance is formed in at least a part of elements of plural elements, in a range of a first fixing portion of a first leg portion to a second fixing portion of a second leg portion via a coupling head portion.

When large lateral pulling force is applied to the first and second fastener stringers in a coupled state by expanding the airbag, the distance of separation is enlarged in the separation portion. When the leg portion of the element is bent and deformed, the coupling cannot be maintained. When lateral pulling force equal to or larger than predetermined tensile rupture strength is applied, the coupling is disengaged.

When the coupling at a part of the slide fastener 10 is disengaged, the coupling between elements of the rows of elements is sequentially disengaged toward the end portion of the slide fastener along the subsequent expansion of the airbag. The airbag is expanded from the separation portion of the slide fastener 10, and impact strength applied to a human body at a collision time can be substantially alleviated and safety of the passenger can be secured. A configuration of the elements interweaved and fixed to the slide fastener 10 according to the invention is explained with reference to FIG. 2.

First Embodiment

Figure 2:
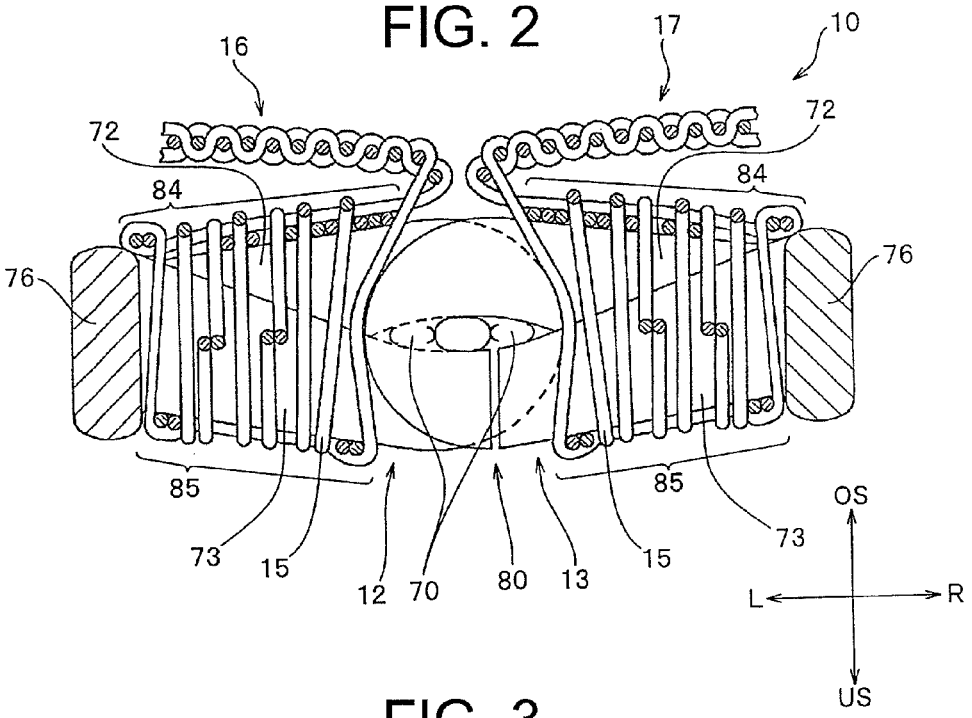
FIG. 2 is a cross-sectional arrow view along a line II-II of a hidden slide fastener shown in FIG. 1.
Figure 3:
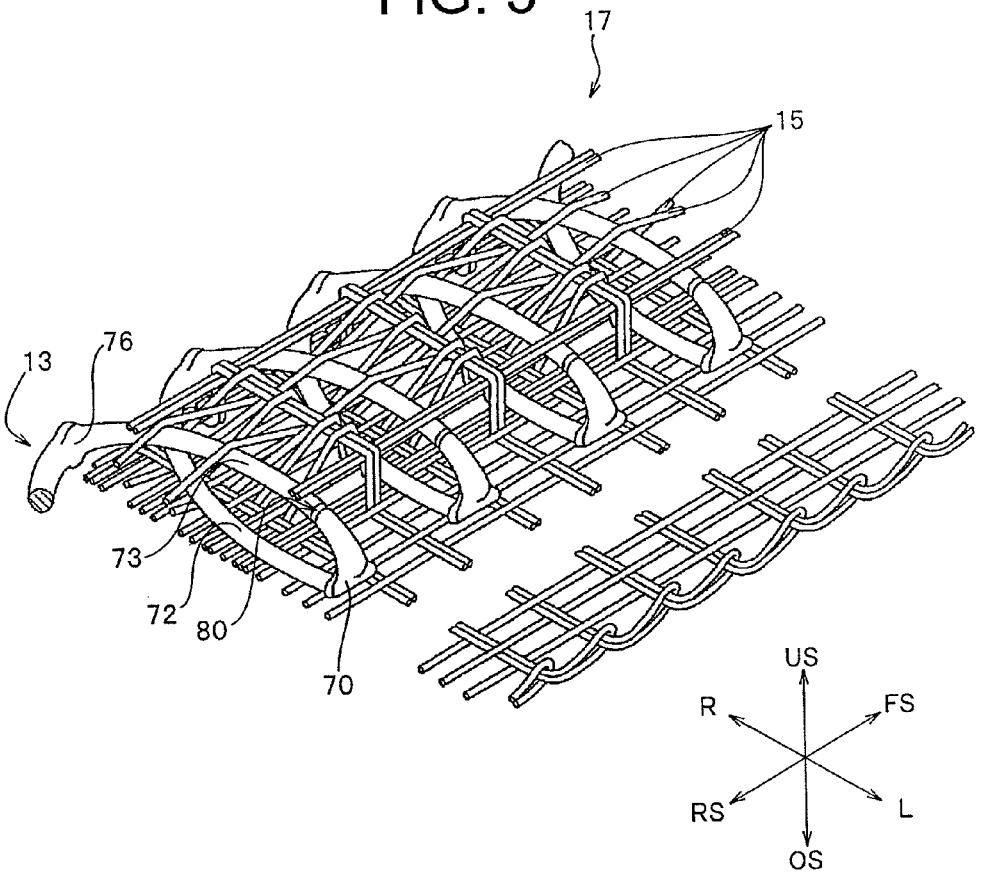
FIG. 3 is an enlarged perspective view for explaining only the second fastener stringer shown in FIG. 2 before folding back the slide fastener.

FIG. 2 is a cross-sectional arrow view along a line II-II of the hidden slide fastener shown in FIG. 1. The cross-sectional view of FIG. 2 is an observation view of the slide fastener in a direction of a coupling axis line of the slide fastener, by cutting a first fastener stringer 16 and a second fastener stringer 17 at left and right sides in a lateral width direction (an L-R direction shown in FIG. 2) of the slide fastener, in a state that the slide fastener 10 is closed. As shown in FIG. 2, the slide fastener 10 includes the first fastener stringer 16 and the second fastener stringer 17, and a row of first elements 12 and a row of second elements 13 arranged along opposite element-attached portions formed in opposite side edge portions of the fastener tape 11 of the first fastener stringer 16 and the second fastener stringer 17. FIG. 3 is an enlarged perspective view for explaining only the second fastener stringer 17 of the slide fastener 10 shown in FIG. 2, and shows appearance of a plane shape before the second fastener stringer 17 is folded back.

As shown in FIGS. 2 and 3, regarding a coordinate system of the slide fastener 10, when the slider 59 (see FIG. 1) is slid, a slide direction in which the row of first elements 12 and the row of second elements 13 become in a coupled state is defined as a front direction of the slide fastener 10 (an FS direction shown in FIG. 3), and a slide direction in which the row of first elements 12 and the row of second elements 13 are separated is defined as a back direction of the slide fastener 10 (an RS direction shown in FIG. 3).

One of fastener tape surfaces of the first and second fastener stringers 16, 17 is defined as a front surface of the slide fastener 10 (an OS direction shown in FIGS. 2 and 3), and the other surface is defined as a back surface (a US direction shown in FIGS. 2 and 3). A right side shown in FIG. 2 is defined as an R direction, and a left side is defined as an L direction.

The slider is not necessarily always required to be connected to the fastener stringer. The slide fastener of which the slider is removed from the fastener stringer after the row of first elements 12 and the row of second elements 13 are coupled together can be used for a vehicle seat, for example.

As shown in FIGS. 2 and 3, the first and second fastener stringers 16, 17 are configured by interweaving the row of first elements 12 and the row of second elements 13, sequentially by a fixing thread 15 (a part of a warp thread), a warp thread and a base weft thread, by forming coupling head portions 70, first leg portions 72, second leg portions 73, and connecting portions 76 on monofilaments made of synthetic resin in a coil shape. The row of first elements 12 and the row of second elements 13 are fixed by using the fixing thread 15 and a warp thread in the first leg portions 72 and the second leg portions 73. A portion where the first leg portion 72 is fixed is defined as a first fixing portion 84, and a portion where the second leg portion 73 is fixed defined as a second fixing portion 85.

The coupling head portions 70 for coupling opposite elements together are formed in the row of first elements 12 and the row of second elements 13 that are fixed to the first and second fastener stringers 16, 17. The first leg portions 72 and the second leg portions 73 are extended respectively from the coupling head portions 70 to a front-to-back direction (an OS-US direction shown in FIGS. 2 and 3) of the slide fastener 10. The first leg portions 72 and the second leg portions 73 are connected to each other at end portions at opposite sides via the connecting portions 76.

When excessive lateral pulling force is applied to the first and second fastener stringers 16, 17 in the coupled state shown in FIGS. 2 and 3, the row of first elements 12 and the row of second elements 13 are cleaved in a lateral direction (an L-R direction). This state is explained next with reference to FIGS. 4 to 6.

Figure 4:
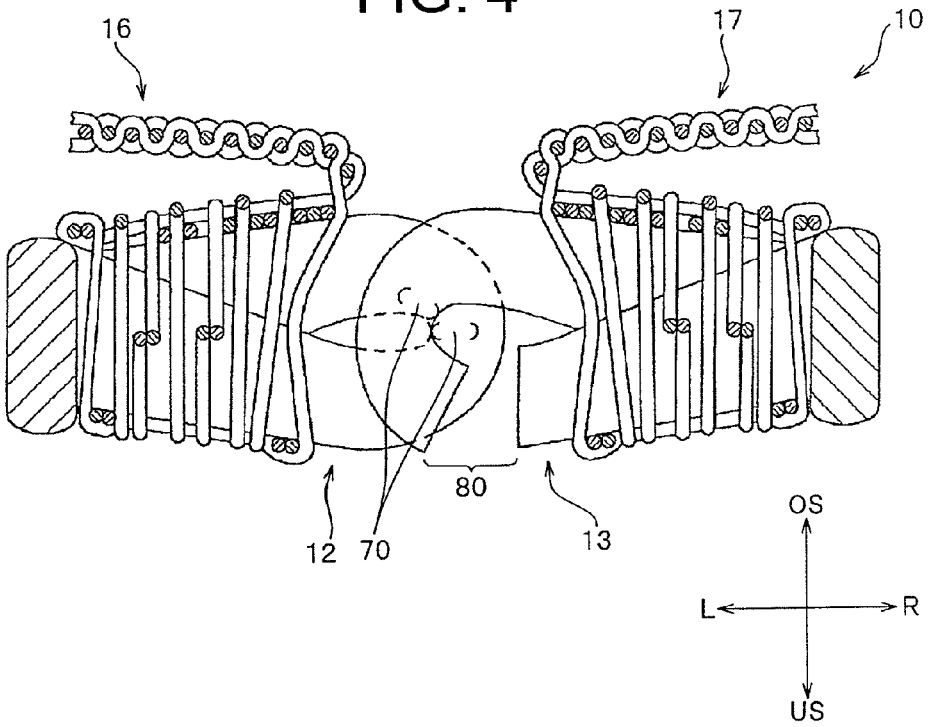
FIG. 4 shows a state that a gap in a separation portion of a second element increases due to application of excessive lateral pulling force in the state shown in FIG. 2.
Figure 5:
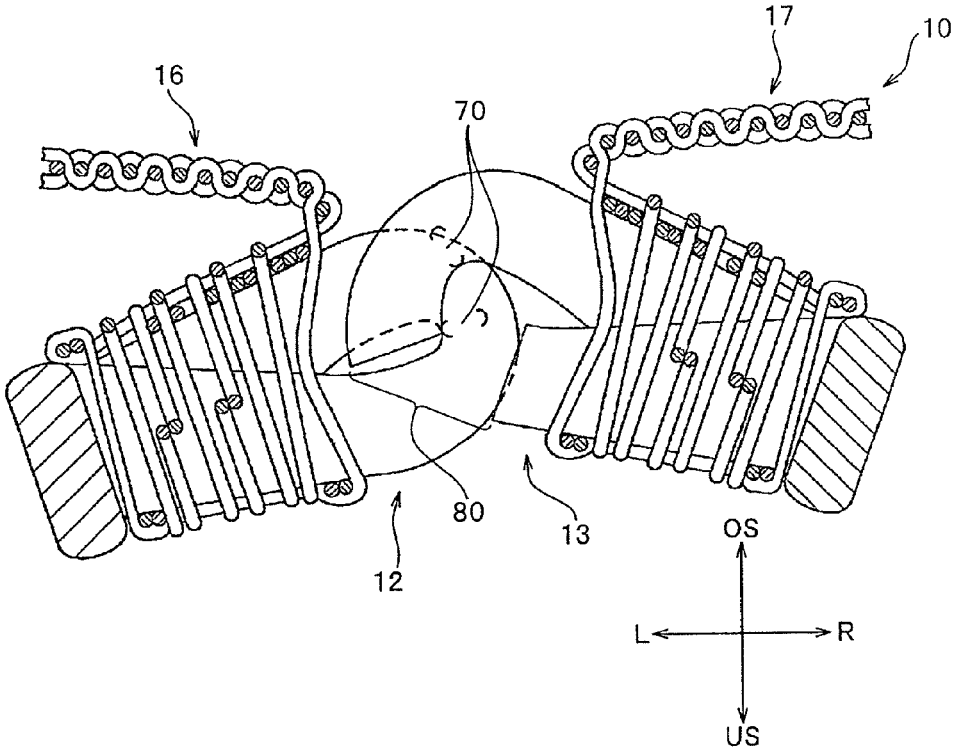
FIG. 5 shows a process that a coupling between a first element and a second element is disengaged due to continuous application of excessive lateral pulling force in the state shown in FIG. 4.

FIG. 4 shows a state that a gap in a separation. portion 80 of the second element 13 increases due to application of excessive lateral pulling force to the first and second fastener stringers 16, 17 in the state shown in FIG. 2. FIG. 5 shows a process that a gap in the separation portion 80 further increases and a coupling is disengaged based on a deviation of the coupling head portions 70 of the first element 12 and the second element 13, due to continuous application of excessive lateral pulling force in the state shown in FIG. 4.

Figure 6:
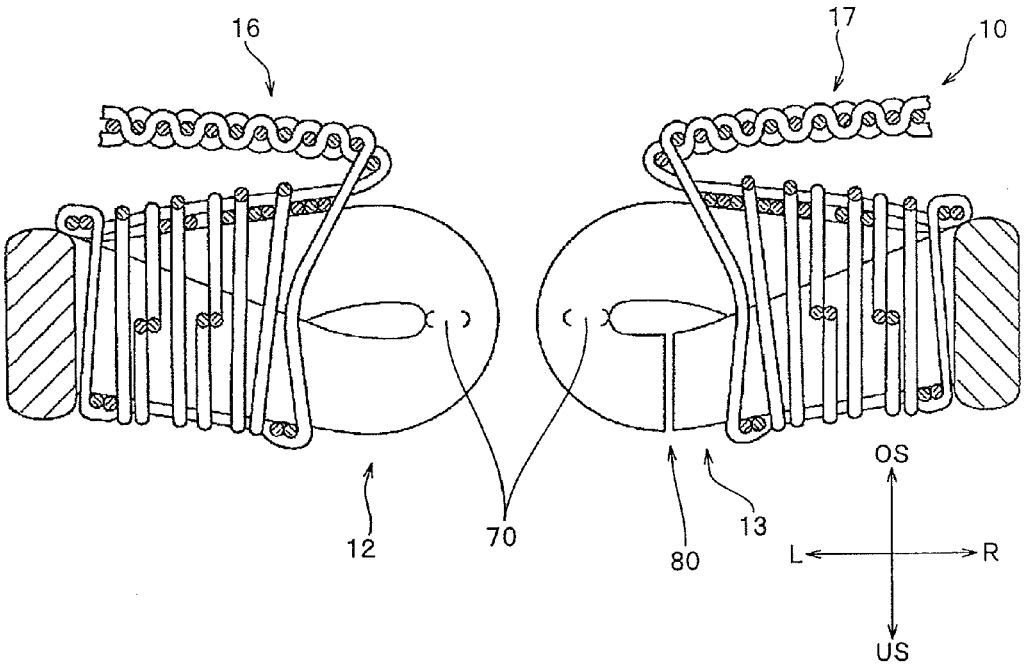
FIG. 6 shows a state that a coupling between a first element and a second element is disengaged and these elements are completely separated due to continuous application of excessive lateral pulling force in the state shown in FIG. 5.

FIG. 6 shows a state that the coupling head portion 70 of the first element 12 passes through the separation portion 80 of the second element 13 and the coupled state is disengaged, and the first element 12 and the second element 13 are completely separated, because the first and second fastener stringers 16, 17 are further pulled in a lateral direction (an L-R direction) from the state shown in FIG. 5.

Monofilaments made of polyester each having a diameter D=0.64 mm are used for the row of first elements 12 and the row of second elements 13, for example. The separation portion 80 that separates a configuration of a part of the elements in advance is formed between the coupling head portion 70 and the second fixing portion 85, as shown in FIG. 2. This case is explained. When lateral pulling force equal to or smaller than 240 N/inch (9.44 N/mm) is applied to the first and second fastener stringers 16, 17 in a lateral direction (an L-R direction), a state as shown in FIG. 4 is obtained. That is, due to the applied lateral pulling force, mainly a portion from the first fixing portion 84 of the second element 13 to the coupling head portion 70 is bent, the gap in the separation portion 80 is opened, and the end portions of the monofilaments are separated.

In the coupled state shown in FIG. 2, the coupling head portions 70 of the first element 12 and the second element 13 are present respectively in parallel (parallel in an L-R direction) with a tape surface of the slide fastener 10. When a portion from the first fixing portion 84 to the coupling head portion 70 of the second element 13 is bent, the coupling head portion 70 of the second element 13 is displaced to a front surface side (an OS direction) of the slide fastener 10, and the coupling between the first element 12 and the second element 13 becomes easily disengaged.

When application of the lateral pulling force is further continued, the gap in the separation portion 80 of the second element 13 further increases, a portion from the first fixing portion 84 to the separation portion 80 of the second element 13 is bent, and the coupling head portion 70 of the second element 13 is disengaged from the first element 12, as shown in FIG. 5. When the coupling head portion 70 of the second element 13 is disengaged from the row of first elements 12 at least at one position of the slide fastener 10 in the coupled state, a gap is generated in the coupling head portions 70 of two first elements 12 in a longitudinal direction (an FS-RS direction) in which the coupling head portions 70 are so far coupled with the disengaged coupling head portion 70.

According to the slide fastener 10, when the coupling head portions 70 are disengaged at one position in this way, a coupling between adjacent elements is sequentially disengaged by weak lateral pulling force, and the row of first elements 12 and the row of second elements 13 can be completely separated as shown in FIG. 6. Therefore, cleavage lateral pulling force of the slide fastener 10 can be stabilized.

Because the separation portion 80 is formed at one position in a range of the first fixing portion 84 of the row of second elements 13 to the second fixing portion 85 via the coupling head portions 70, inconvenience of occurrence of a ruptured piece in the row of first elements 12 or the row of second elements 13 before the row of first elements 12 and the row of second elements 13 are separated can be reduced.

Second Embodiment

An embodiment that the separation portion 80 is formed in a row of first elements 112 and the row of second elements 13 of both a first fastener stringer 116 and the second fastener stringer 17 is explained with reference to FIG. 7. In the embodiment shown in FIG. 2, the separation portion 80 that separates a configuration of a part of elements is formed at a portion from the first fixing portion 84 of the row of second elements 13 at the right side to the second fixing portion 85 via the coupling head portion 70.

Figure 7:
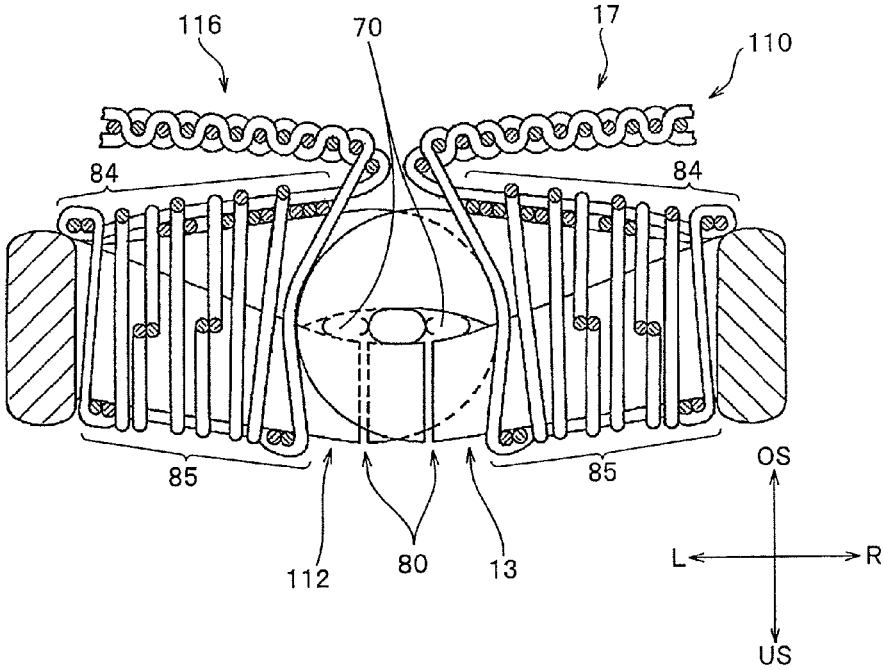
FIG. 7 shows an embodiment that a separation portion is formed in both elements of a row of first elements and a row of second elements at left and right.

On the other hand, FIG. 7 shows an embodiment that the separation portion 80 is formed, being separated at a part of the second leg portion from the first fixing portion 84 to the second fixing portion 85 via the coupling head portions 70 of both elements of the row of first elements 112 and the row of second elements 13 at left and right.

Explanation of portions that have the same functions as those of portions explained with reference to FIG. 2 is omitted. As shown in FIG. 7, cleavage lateral pulling force of about 240 N/inch (9.44 N/mm) can be also obtained by forming the separation portion 80 in elements of both the row of first elements 12 and the row of second elements 13.

Third Embodiment

Next, an embodiment that a row of first elements 212 and a row of second elements 213 formed by monofilaments in a coil shape are sewed to the fastener tape 11 to form a first fastener stringer 216 and a second fastener stringer 217 is explained. Explanation of portions that have the same functions as those of portions explained with reference to FIG. 2 is omitted.

In the embodiment shown in FIG. 2, the first and second fastener stringers 16, 17 are configured by interweaving the row of first elements 12 and the row of second elements 13 formed by monofilaments in a coil shape, sequentially by the fixing thread 15 (a part of a warp thread), the warp thread and the base weft thread. On the other hand, cleavage lateral pulling force of about 240 N/inch (9.44 N/mm) can be also obtained by using the first fastener stringer 216 which is configured by forming the separation portion 80 at a portion from the first fixing portion 84 of the row of first elements 212 at the left side to the second fixing portion 85 via the coupling head portions 70, inserting a core portion 14 into the row of first elements 212, and by sewing the rows of elements to the fastener tape 11 using the fixing thread 215, as shown in FIG. 8.

Figure 8:
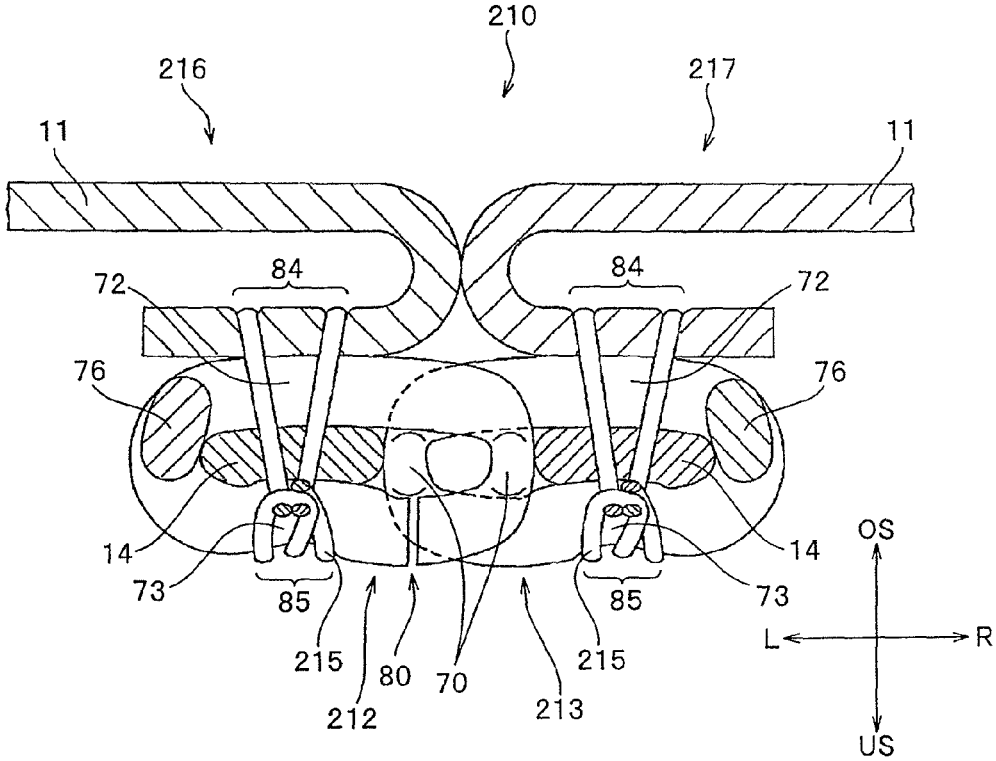
FIG. 8 shows an embodiment of a fastener stringer in which a separation portion is formed in elements that are sewed to a fastener tape by using a fixing thread.

In the embodiment of the slide fastener 210 shown in FIG. 8, the separation portion 80 is formed in only the first element 212 at the left side (an L direction). However, the separation portion 80 can be also formed in both the row of first elements 212 and the row of second elements 213 as shown in FIG. 7.

Fourth Embodiment

Next, an embodiment that the separation portion 80 that is ruptured when lateral pulling force equal to or larger than cleavage lateral pulling force is applied is formed in a row of first elements 312 of a first fastener stringer 316 is explained with reference to FIGS. 9 and 10. In the embodiment shown in FIG. 2, the separation portion 80 having a configuration of a part of elements ruptured in advance is formed at a portion from the first fixing portion 84 of the second element 13 at the right side to the second fixing portion 85 via the coupling head portions 70. On the other hand, the separation portion 80 of the row of first elements 312 shown in FIGS. 9 and 10 according to the embodiment is that a rupture portion 81 having a reduced cross-sectional area to weaken tensile rupture strength is formed in advance.

Figure 9:
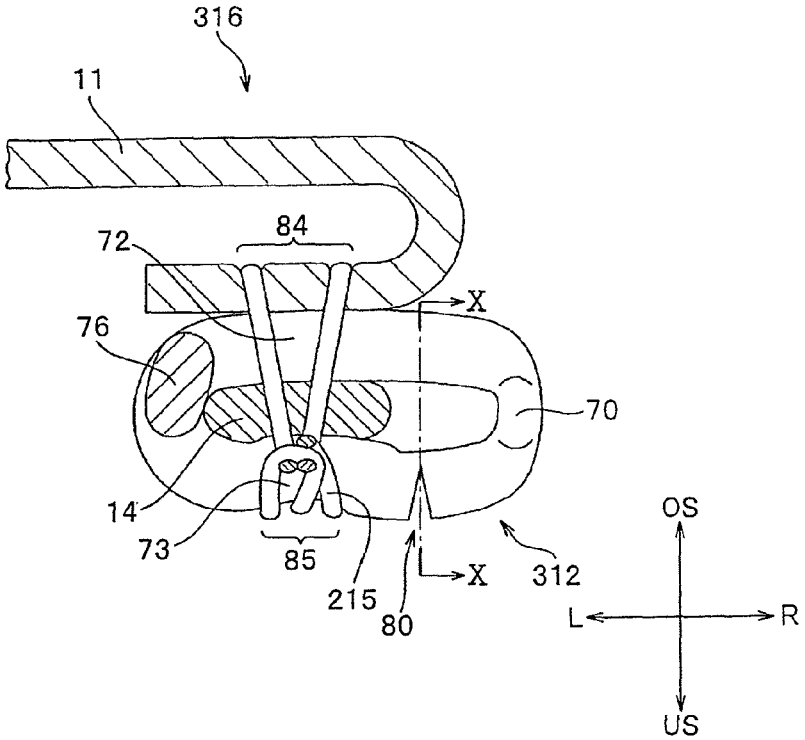
FIG. 9 shows an embodiment that a rupture portion having a reduced cross-sectional area to weaken tensile rupture strength is formed in a separation portion of an element.

FIG. 9 is a cross-sectional view of the first fastener stringer 316 that is cut in a cross section perpendicular to a coupling axis line. FIG. 10 is a cross-sectional arrow view along a line X-X in FIG. 9. Explanation of portions that have the same functions as those of portions explained with reference to FIG. 2 is omitted.

When forming the separation portion 80 in the first element 312 shown in FIG. 9, the core portion 14 is first inserted into the row of first elements 312 formed by monofilaments in a coil shape, and is fixed to the fastener tape 11 by using the fixing thread 215. Thereafter, the separation portion 80 is formed by a cut in a V shape, for example, along the coupling axis line from the backside (a US direction) of the first fastener stringer 316 toward the frontside (an OS direction) in the row of first elements 312.

Figure 10:
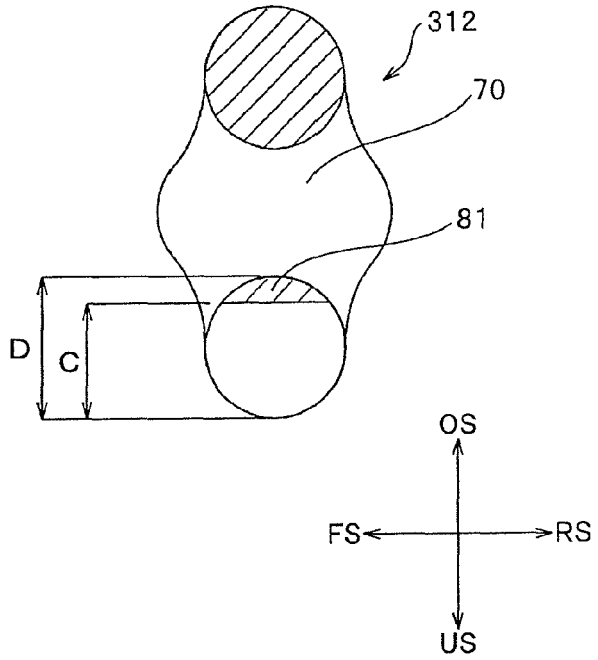
FIG. 10 is a cross-sectional arrow view along a line X-X in FIG. 9, and shows a diameter D, a depth C of a cut in an element, and a cross-sectional shape of a rupture portion.

As shown in FIG. 10, a diameter of each monofilament is defined as D, and a depth of a cut constituting the separation portion 80 is defined as C. A remaining cross-sectional area of the monofilament formed in this way is defined as a cross-sectional area of the rupture portion 81.

Cleavage lateral pulling force of the slide fastener 10 that has the second element 13 on which the separation portion 80 that separates a configuration of a part of the element in advance as shown in FIG. 2 is about 240 N/inch (9.44 N/mm), for example. When the slide fastener is to be applied to a usage that requires cleavage lateral pulling force much stronger than the cleavage lateral pulling force of the slide fastener 10 shown in FIG. 2, it is advisable to use an element on which the rupture portion 81 having a predetermined cross-sectional area is formed in place of the separation portion 80 that separates a configuration of a part of the element in advance.

As explained later with reference to FIG. 26, when each monofilament using polyester of tensile strength 400N/mm$^2$ as a material has a diameter D=0.64 mm and also when a depth of a cut constituting the separation portion 80 is C=0.4 mm, for example, a cross-sectional area of the rupture portion 81 becomes about 0.1 mm$^2$. By suitably setting the cross-sectional area of the separation portion 80 in this way, cleavage lateral pulling force can be set in a range of about 240 N/inch to 500 N/inch 9.44 N/mm to 19.7 N/mm).

In the embodiment shown in FIGS. 9 and 10, the rupture portion 81 that has a reduced cross-sectional area of monofilaments is formed by forming a cut in a V shape in a part of the monofilaments constituting the first element 312. However, the invention is not limited to the cut in a V shape. A rupture portion that has a reduced cross-sectional area can be also formed by forming an opening that is open in a diametric direction of the monofilaments.

Figure 11:
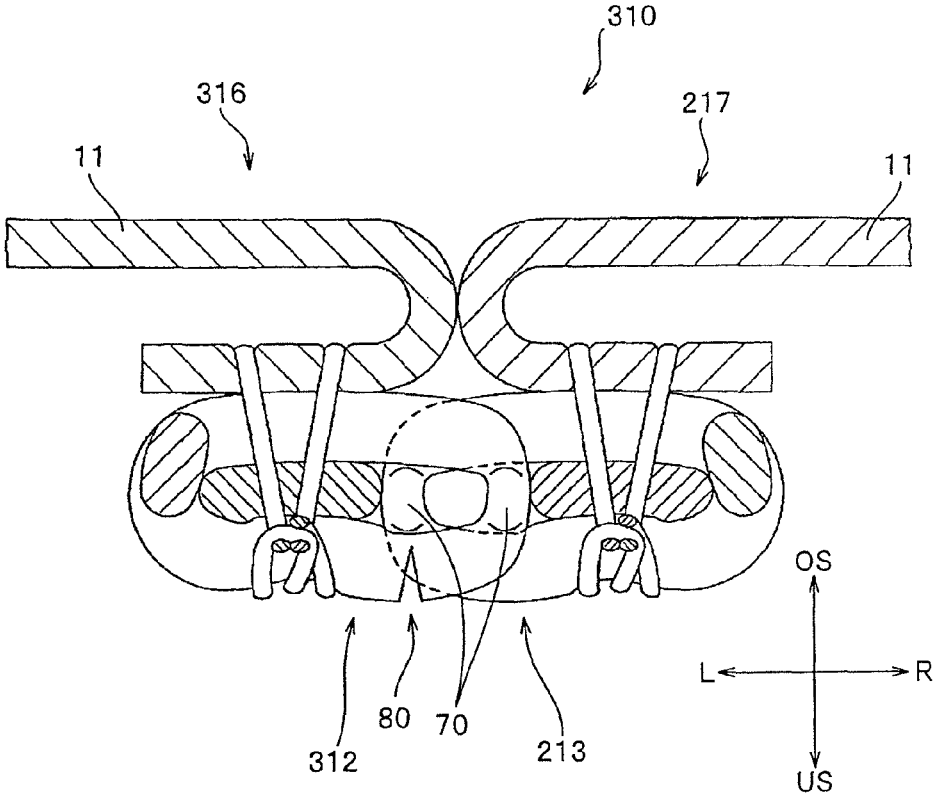
FIG. 11 is a cross-sectional view of a slide fastener showing a state that the rows of elements in which a rupture portion having a reduced cross-sectional area in a separation portion of the elements are coupled.

Next, a state that the row of first elements 312 and the row of second elements 213 shift from a coupled state to a separated state by applying lateral pulling force equal to or larger than cleavage lateral pulling force to the slide fastener 310 using the row of first elements 312 shown in FIGS. 9 and 10 is explained with reference to FIGS. 11 to 14. FIG. 11 is a cross-sectional view of the slide fastener 310 when the row of first elements 312 and the row of second elements 213 are in a coupled state.

Figure 12:
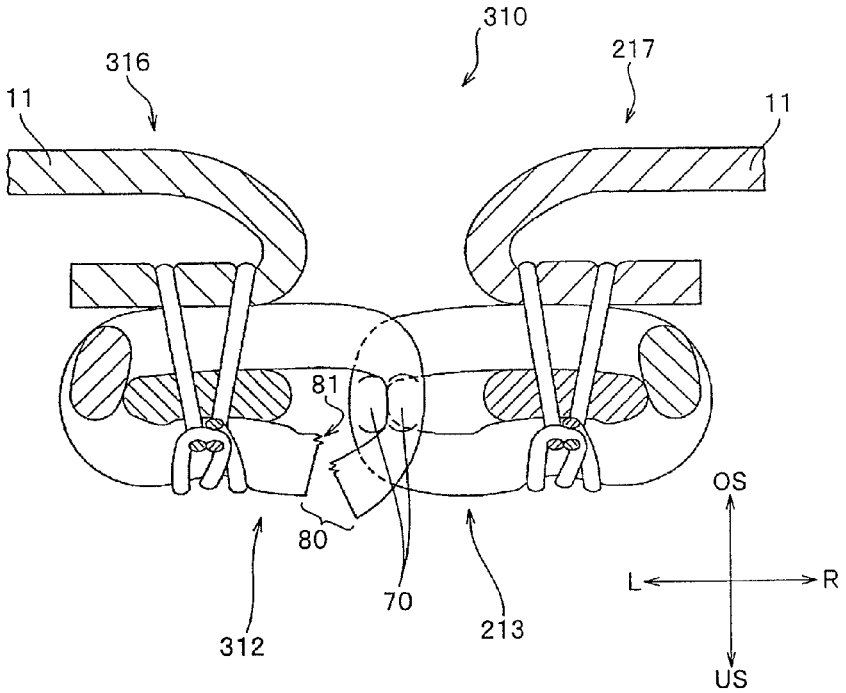
FIG. 12 shows a state that a rupture occurs in a rupture portion of a first element due to application of excessive pulling force in the state shown in FIG. 11.
Figure 13:
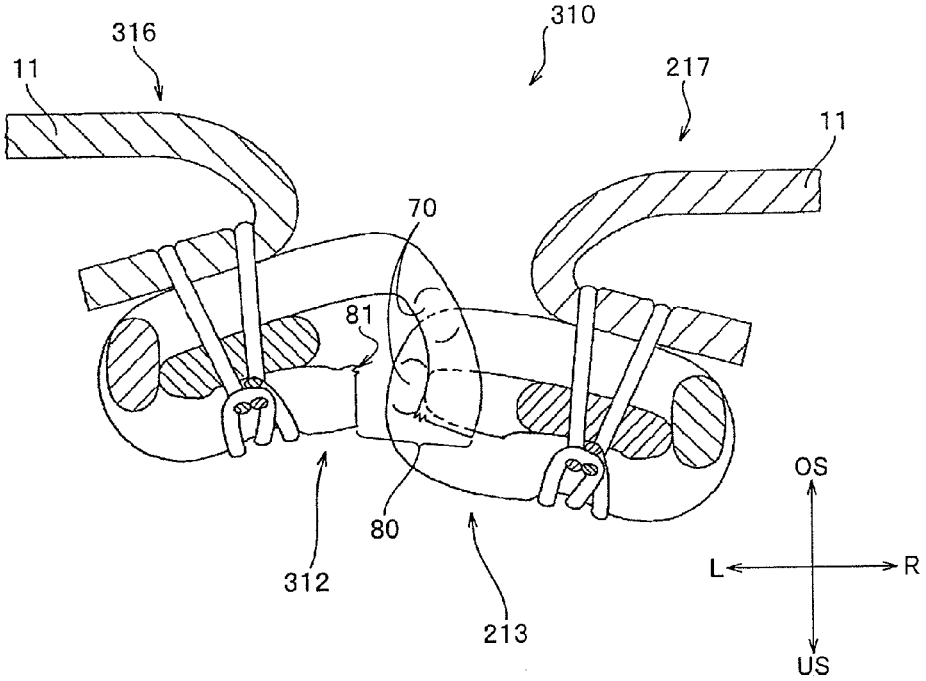
FIG. 13 shows a process that a coupling between a first element and a second element is disengaged due to continuous application of excessive lateral pulling force in the state shown in FIG. 12.

FIG. 12 shows a state that a rupture occurs in the rupture portion 81 of the first element 312 and a gap in the separation portion 80 of the first element 312 increases due to application of lateral pulling force equal to or larger than cleavage lateral pulling force to the first fastener stringer 316 and a second fastener stringer 217 at left and right sides from a state shown in FIG. 11. FIG. 13 shows a process that the gap in the separation portion 80 of the first element 312 further increases and the coupling between the coupling head 70 of the first element 312 and the coupling head 70 of the second element 213 is disengaged as a result of continuous application of excessive lateral pulling force from the state shown in FIG. 12.

Figure 14:
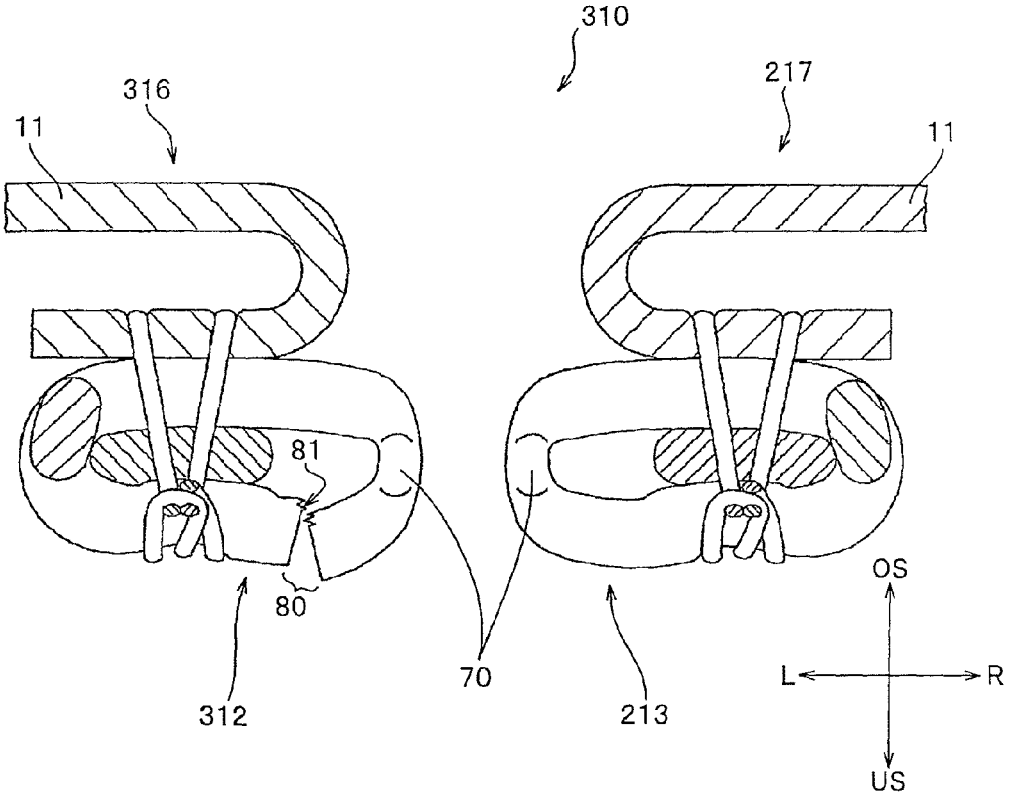
FIG. 14 shows a state that a coupling between a first element and a second element is disengaged and the elements are completely separated due to continuous application of excessive pulling force in the state shown in FIG. 13.

FIG. 14 shows a state that the coupling head portion 70 of the second element 213 passes through the separation portion 80 of the first element 312 and the coupling is disengaged, and the first element 312 and the second element 213 are completely separated, because the first and second fastener stringers 316, 217 are further pulled in a lateral direction (an L-R direction) from the state shown in FIG. 13. Explanation of portions that have the same functions as those of portions explained with reference to FIG. 2 is omitted.

Assume that lateral pulling force equal to or larger than 500 N/inch (19.7 N/mm) is applied to the first and second fastener stringers 316, 217 in a lateral direction (an L-R direction), when monofilaments made of polyester in a diameter D=0.64 mm are used for the row of first elements 312 and the row of second elements 213 and when the separation portion 80 having a depth of a cut C=0.4 mm is formed as shown in FIG. 10, for example. Then, as shown in FIG. 12, tensile force that exceeds tensile rupture strength 40N is applied to the rupture portion 81 formed in the separation portion 80 of the first element 312, due to the applied lateral pulling force. Consequently, the first element 312 is ruptured in the rupture portion 81, and the gap in the separation portion 80 increases.

When the gap in the separation portion 80 increases, the ruptured first element 312 is bent, the gap in the separation portion 80 is further opened, and the coupling head portion 70 of the first element 312 is displaced to a front surface side (an OS direction) of the slide fastener 310 as shown in FIG. 13. Consequently, the coupling between the first element 312 and the second element 213 becomes easily disengaged.

When lateral pulling force is continuously applied, the coupling head portion 70 of the first element 312 is disengaged from the second element 213. When the coupling head portion 70 of the first element 312 is disengaged from the row of second elements 213 at least at one position of the slide fastener 310 in the coupled state, the coupling between adjacent elements is sequentially disengaged with relatively weak lateral pulling force, and the row of first elements 312 and the row of second elements 213 can be completely separated as shown in FIG. 14. By suitably setting a cross-sectional area of the rupture portion 81 in this way, tensile rupture strength of the rupture portion 81 can be adjusted. Further, cleavage lateral pulling force of the slide fastener 310 can be set higher.

Fifth Embodiment

Figure 15:
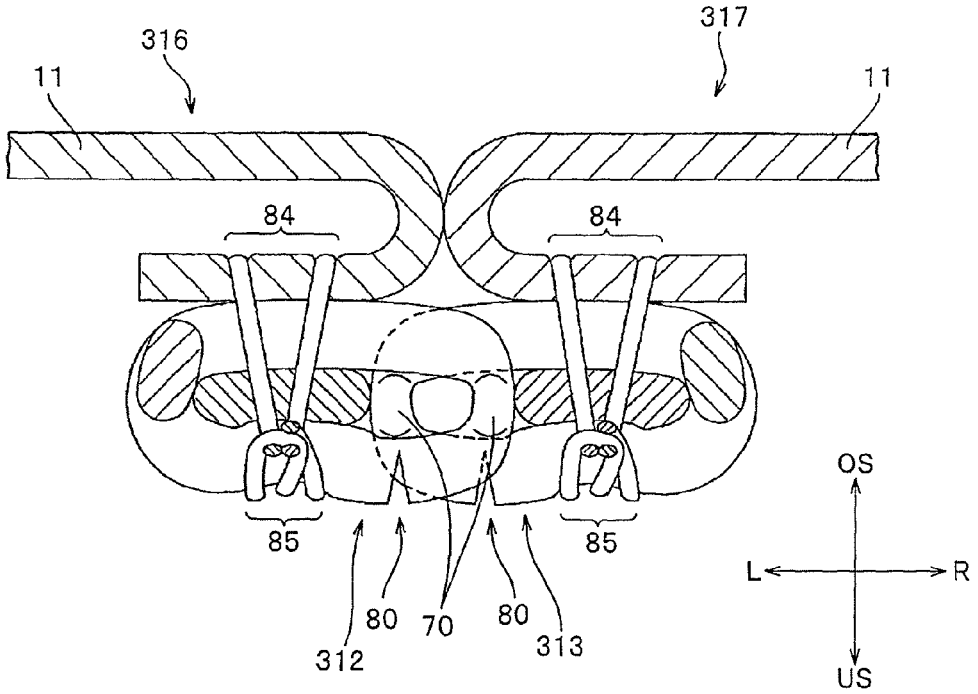
FIG. 15 shows an embodiment that a rupture portion is formed in both elements of the row of first elements and the row of second elements at left and right sides.

Next an embodiment that the rupture portions 81 are formed in the separation portions 80 of the row of first elements 312 and a row of second elements 313 of both the first fastener stringer 316 and the second fastener stringer 317 is explained with reference to FIG. 15. Explanation of portions that have the same functions as those of portions explained with reference to FIGS. 9 and 11 is omitted.

In the embodiment shown in FIG. 11, the rupture portion 81 that is ruptured when lateral pulling force equal to or larger than cleavage lateral pulling force is applied is formed in the separation portion 80, in the row of elements 312 at the left side. On the other hand, FIG. 15 shows the embodiment that the rupture portions 81 are formed in the separation portions

80 of both elements of the row of first elements 312 and the row of second elements 313 at left and right sides. As shown in FIG. 15, cleavage lateral pulling force can be also formed in a range of about 240 N/inch to 500 N/inch (9.44 N/mm to 19.7 N/mm) by forming the rupture portions 81 in the separation portions 80 of both elements of the row of first elements 312 and the row of second elements 313.

Sixth Embodiment

Next, an embodiment that the separation portion 80 is formed by forming a cut in a V shape from a frontside (an OS direction) toward a backside (a US direction), in a row of first elements 412 of a first fastener stringer 416 is explained with reference to FIG. 16. Explanation of portions that have the same functions as those of portions explained with reference to FIG. 9 and the like is omitted.

In the embodiment shown in FIG. 9, the separation portion 80 is formed by forming a cut in a V shape from a backside (a US direction) toward a frontside (an OS direction) of the first fastener stringer 316, in the row of first elements 312, oppositely to the case in. FIG. 16. As shown in FIG. 16, predetermined cleavage lateral pulling force can be also obtained by forming the separation portion 80 by forming a cut in a V shape from a frontside (an OS direction) toward a backside (a US direction) of the first fastener stringer 416, in the row of first elements 412.

Figure 16:
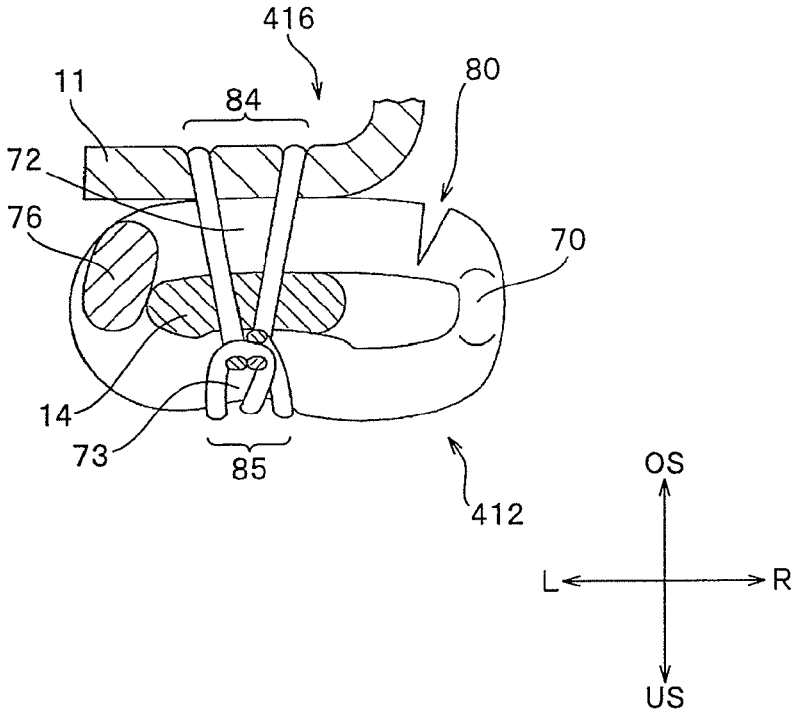
FIG. 16 shows an embodiment that a separation portion is formed by forming a cut in a V shape in a range from a frontside of an element (an OS direction) toward a backside (a US direction).

In FIG. 16, cleavage lateral pulling force of about 500 N/inch (19.7 N/mm) can be obtained by forming the separation portion 80 having a cut in the depth C=0.4 mm by using monofilaments using polyester having a diameter D=0.64 mm as a material of the row of first elements 412, in a similar manner to that shown in FIG. 10. In this way, cleavage lateral pulling force can be formed in a range of about 240 N/inch to 500 N/inch (9.44 N/mm to 19.7 N/mm) by suitably setting a cross-sectional area of the separation portion 80.

Seventh Embodiment

Figure 17:
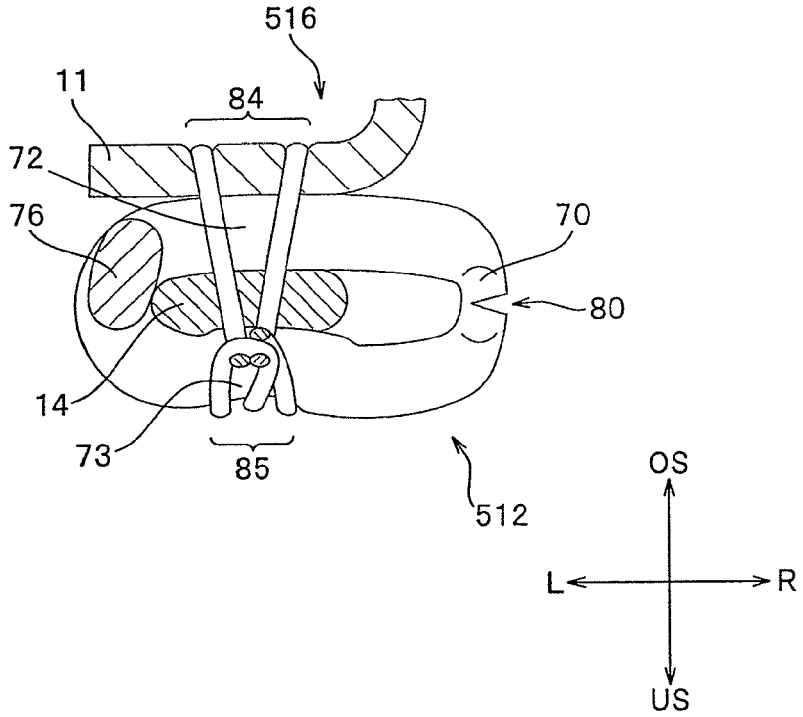
FIG. 17 shows an embodiment that a separation portion is formed by forming a cut in a V shape in a coupling head portion of an element.

Next, an embodiment that the separation portion 80 is formed by forming a cut in a V shape in the coupling head portion 70 of a row of first elements 512 of a first fastener stringer 516 is explained with reference to FIG. 17. Explanation of portions that have the same functions as those of portions explained with reference to FIG. 9 and the like is omitted.

In the embodiment shown in FIG. 9 and FIG. 16, the rupture portion 81 that is ruptured when lateral pulling force equal to or larger than cleavage lateral pulling force is applied is formed in a portion from the first fixing portion 84 or the second fixing portion 85 of the row of first elements to the coupling head portion 70 is explained. On the other hand, as shown in FIG. 17, predetermined cleavage lateral pulling force can be also obtained by forming the separation portion 80 by forming a cut in a V shape in the coupling head portion 70 of the row of first elements 512.

Eighth Embodiment

Figure 18:
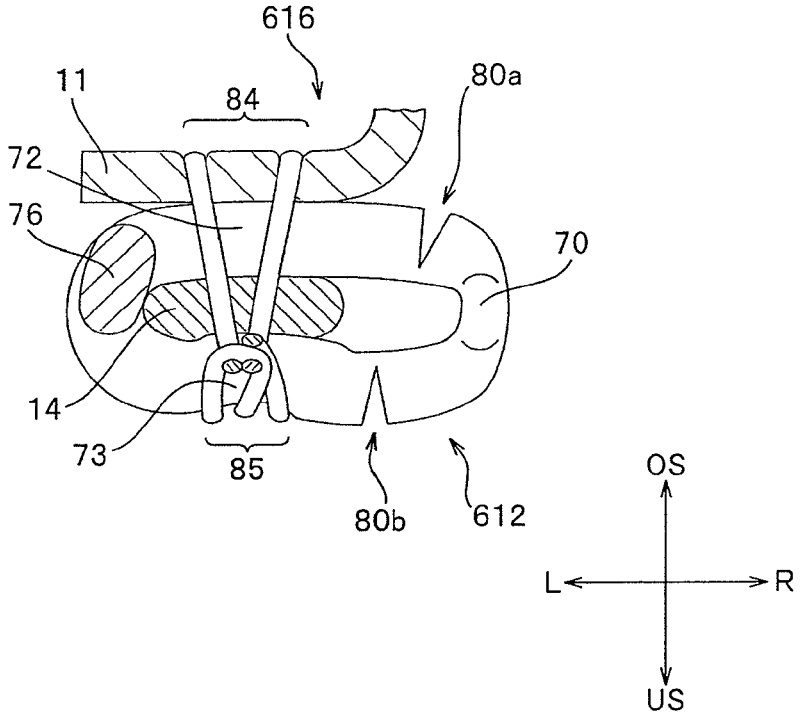
FIG. 18 shows an embodiment of elements that have plural separation portions formed.

Next, an embodiment that plural separation portions 80*a*, 80*b* are formed in a row of first elements 612 of a first fastener stringer 616 is explained with reference to FIG. 18. Explanation of portions that have the same functions as those of portions explained with reference to FIGS. 9 and 16 is omitted.

In the embodiment shown in FIGS. 9 and 16, the separation portion 80 is formed at one position in a range of the first fixing portion 84 or the second fixing portion 85 of the row of first elements to the coupling head portion 70. On the other hand, predetermined cleavage lateral pulling force can be also obtained by forming the plural separation portions 80*a*, 80*b* by forming a cut in a V shape in a range of the first fixing portion 84 to the second fixing portion 85 of the row of first elements 612 as shown in FIG. 18.

Ninth Embodiment

An embodiment that the separation portion 80 having a small diameter that is ruptured when lateral pulling force equal to or larger than cleavage lateral pulling force is applied is formed in a row of first elements 712 of a first fastener stringer 716 is explained with reference to FIGS. 19 and 20. In the embodiment shown in FIGS. 9 and 10, the rupture portion 81 having a reduced cross-sectional area is formed by forming a cut in a V shape, to weaken tensile rupture strength of the first element 312. On the other hand, in the embodiment shown in FIGS. 19 and 20, the separation portion 80 having a reduced cross-sectional area is formed by forming the rupture portion 81 of a smaller diameter than that of monofilaments constituting the first element 712, to weaken tensile rupture strength of the first element 712.

Figure 19:
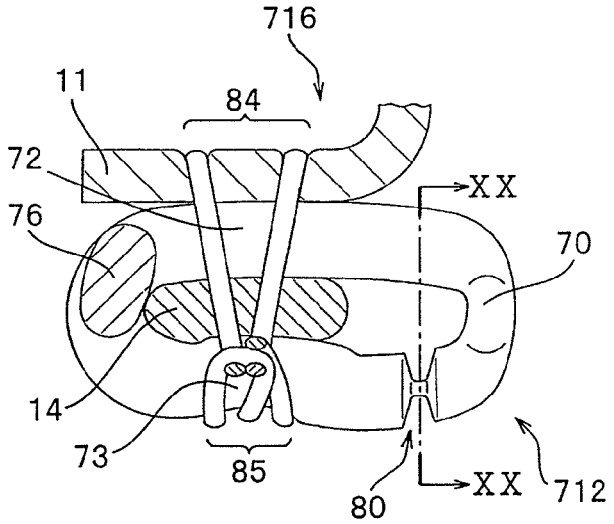
FIG. 19 shows an embodiment that a rupture portion of a small diameter is formed to weaken tensile rupture strength in a separation portion of an element.
Figure 20:
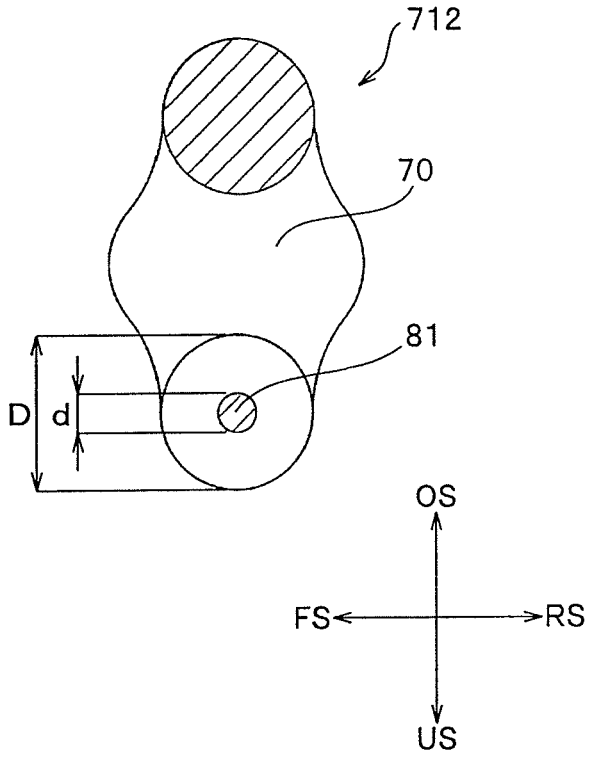
FIG. 20 is a cross-sectional arrow view cut along a line XX-XX in FIG. 19, and shows a diameter D and a small diameter d of an element.

FIG. 19 is a cross-sectional area of the first fastener stringer 716 that is cut in a cross section perpendicular to a coupling axis line. FIG. 20 is a cross-sectional arrow view along a line XX-XX in FIG. 19. Explanation of portions that have the same functions as those of portions explained with reference to FIGS. 9 and 10 is omitted.

As explained later with reference to FIG. 26, when monofilaments that use polyester having tensile strength 400 N/mm$^2$ as a material have a diameter D=0.64 mm and also when a portion constituting the separation portion 80 has a diameter d=0.36 mm, for example, the rupture portion 81 has a cross-sectional area of about 0.1 mm$^2$. Cleavage lateral pulling force in this condition can be increased to about 500 N/inch (19.7 N/mm). By suitably setting a cross-sectional area of the separation portion 80 in a range of 0 mm$^2$ to 0.1 mm$^2$, cleavage lateral pulling force can be set in a range of about 240 N/inch to 500 N/inch (9.44 N/mm to 19.7 N/mm).

Tenth Embodiment

Next, an embodiment that a row of second elements 813 are sewed to a front side (an OS side) of a second fastener stringer 817 of a plane shape and lateral pulling force equal to or larger than cleavage lateral pulling force is applied to the row of second elements 813 is explained with reference to FIG. 21. In the embodiment shown in FIG. 9, a curved edge is formed by folding inside a coupled side of the first fastener stringer 316 of a U shape, and the row of first elements 312 are sewed by using the fixing thread 215 to an element-attached portion at an end side folded in a U shape so as to be projected outward the coupling head portion 70.

Figure 21:
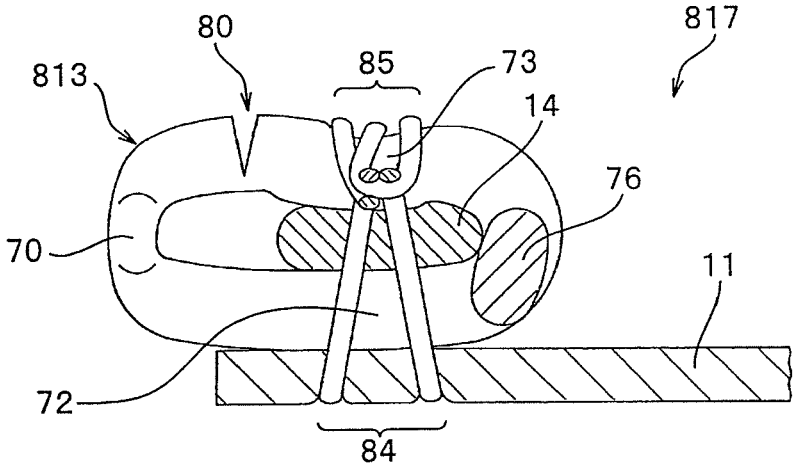
FIG. 21 shows an embodiment that a row of elements that is formed with a separation portion is sewed to a frontside (an OS direction) of a fastener stringer of a plane shape.

As shown in FIG. 21, cleavage lateral pulling force can be also set in a range of about 240 N/inch to 500 N/inch (9.44 N/mm to 19.7 N/mm) by suitably setting a cross-sectional area of the separation portion 80, by using the second fastener stringer 817 that has the row of second elements 813 sewed to a front side (an OS direction) of the fastener tap 11 of a plane shape that is not folded in a U shape.

Eleventh Embodiment

Figure 22:
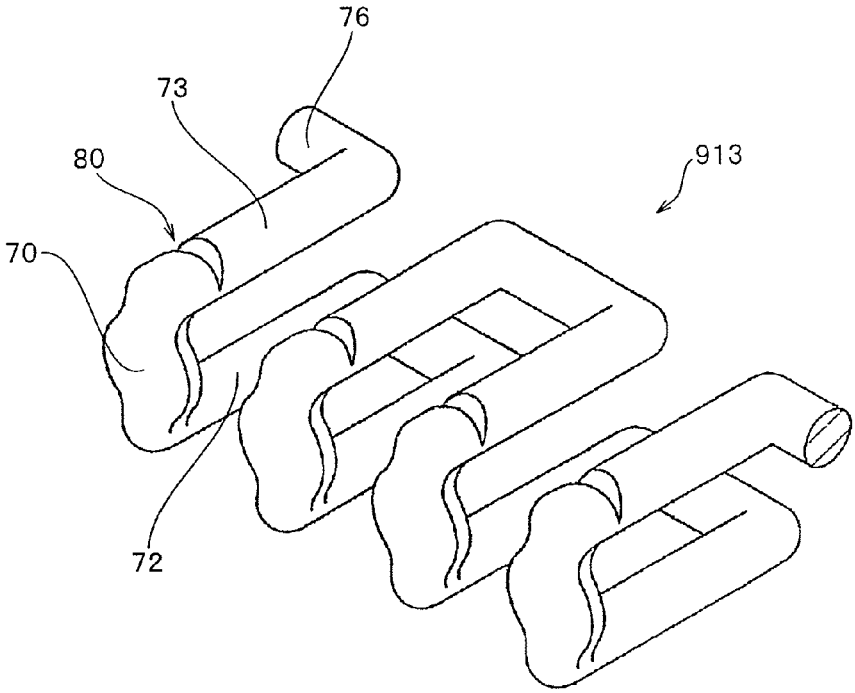
FIG. 22 shows an embodiment that a separation portion is formed in monofilaments in a zigzag shape.

Next, an embodiment that the separation portion 80 that is ruptured when lateral pulling force equal to or larger than cleavage lateral pulling force is applied is formed in a range of the first fixing portion 84 to the second fixing portion 85 of monofilaments made of synthetic resin of a continuous zigzag shape is explained with reference to FIG. 22. FIG. 22 is a perspective view of a row of second elements 913 having the separation portion 80 formed at a part of the row of second elements 913 in a zigzag shape. Explanation of portions that have the same functions as those of portions explained with reference to FIG. 21 is omitted.

In the embodiment shown in FIG. 21 and the like, the separation portion 80 is formed in a range of the first fixing portion 84 to the second fixing portion 85 of monofilaments in a coil shape. Cleavage lateral pulling force can be also set in a range of about 240 N/inch to 500 N/inch (9.44 N/mm to 19.7 N/mm) by suitably setting a cross-sectional area of the separation portion 80, by forming the separation portion 80 in monofilaments in a zigzag shape as shown in FIG. 22.

Twelfth Embodiment

Figure 23:
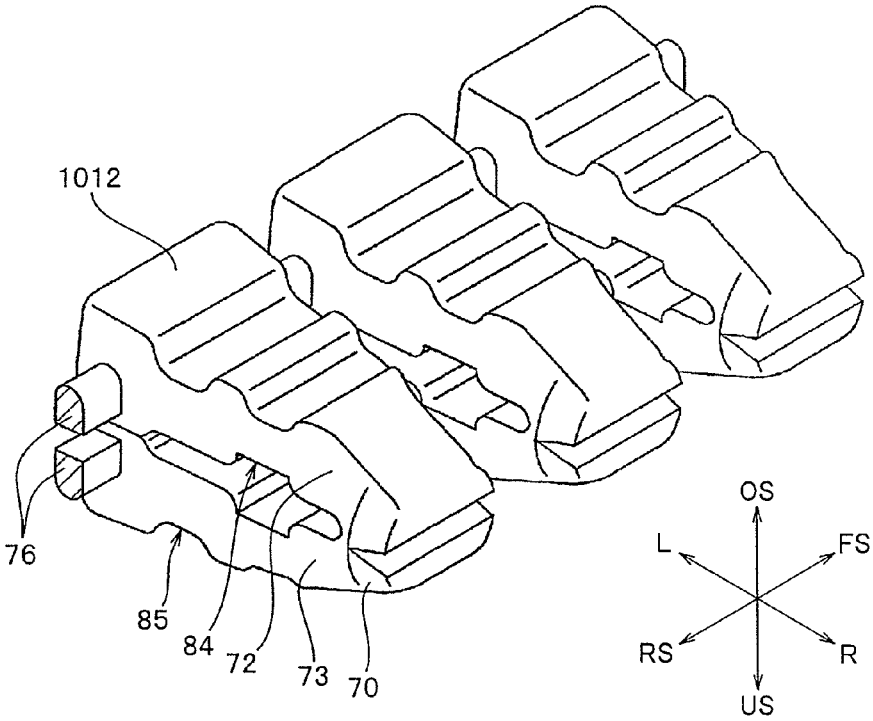
FIG. 23 is a perspective view of a row of elements showing an embodiment that a separation portion is formed in a part of elements formed by injection molding.
Figure 24:
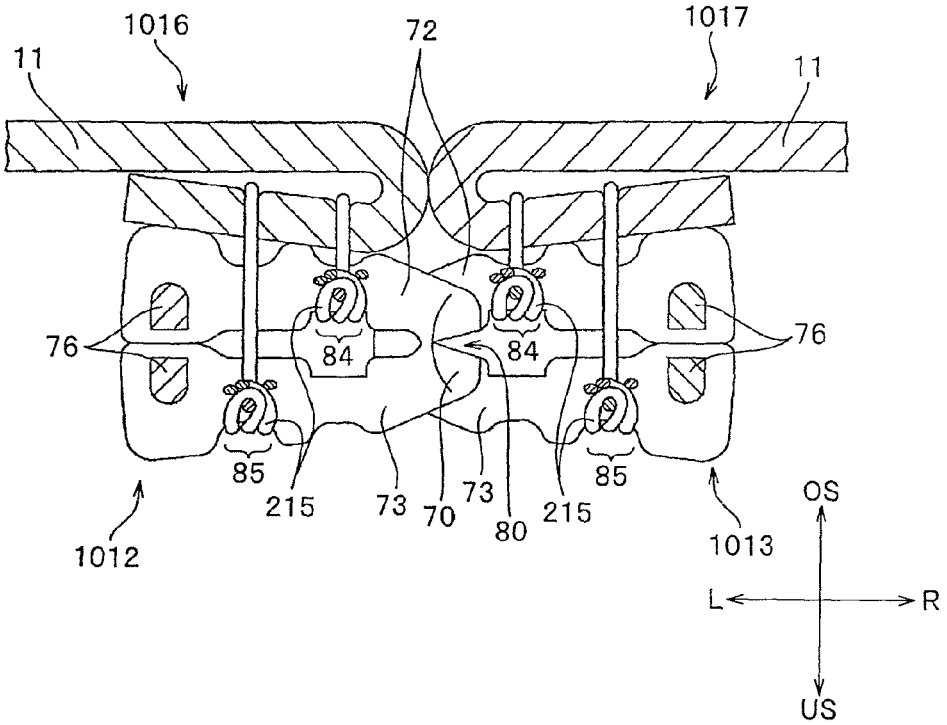
FIG. 24 is a cross-sectional view of a first fastener stringer and a second fastener stringer showing a state that a coupling between elements of a row of first elements shown in FIG. 23 and a row of second elements at the opposite side is cut in a cross section perpendicular to a coupling axis line.

Next, an embodiment that a separation portion is formed in a part of elements molded by injection molding is explained with reference to FIGS. 23 to 25. FIG. 23 is a perspective view of a row of first elements 1012 showing a state that the separation portion 80 having tensile rupture strength reduced to 40N or below is formed in a part of the row of first elements 1012 that are formed by injection molding. FIG. 24 is a cross-sectional view of a first fastener stringer 1016 and a second fastener stringer 1017 showing that a coupled state of the row of first elements 1012 shown in FIG. 23 and a row of second elements 1013 at an opposite side is cut in a cross section perpendicular to a coupling axis direction.

Figure 25:
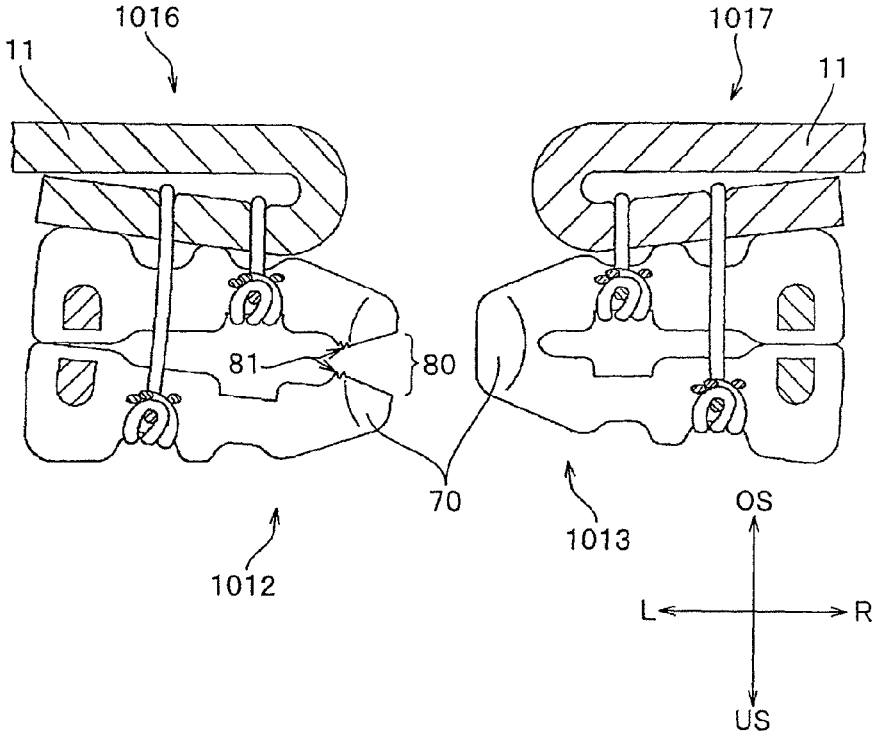
FIG. 25 shows a state that a rupture occurs in a rupture portion of a first element due to application of excessive lateral pulling force in the state shown in FIG. 24 and that the first element and the second element are completely separated from each other.

FIG. 25 shows a state that a rupture occurs in the rupture portion 81 of the first element 1012 due to application of lateral pulling force equal to or larger than cleavage lateral pulling force to the first fastener stringer 1016 and the second fastener stringer 1017 at left and right sides in the state shown in FIG. 24 and that the coupling head portion 70 of the first element 1013 passes through the separation portion 80 of the first element 1012 and the coupling is disengaged, and the first element 1012 and the second element 1013 are completely separated from each other. Explanation of portions that have the same functions as those of portions explained with reference to FIG. 23 is omitted.

The row of first elements 1012 shown in FIG. 23 has the coupling head portions 70 for coupling the pair of elements at left and right sides, and the first leg portions 72 and the second leg portions 73 that are extended respectively from the coupling head portions 70 to a left side (an L direction). The separation portion 80 in a recessed shape having a reduced cross-sectional area of the coupling head portion 70 is formed at a center of each coupling head portion 70 in the row of first elements 1012. The separation portion 80 can be arranged to be formed in only the row of first elements 1012 or in both rows of elements at left and right sides.

The first fixing portion 84 (a concave trench) that the fixing thread 215 strides to sew the fastener tape 11 (see FIGS. 24 and 25 explained later) is formed in advance at a portion of a second leg portion 73 side in a portion between an end of the first leg portion 72 extended from the coupling head portion 70 of the row of first elements 12 and the coupling head portion 70. Further, the second fixing portion 85 (a concave trench) that the fixing thread 215 strides is also formed in advance at an external peripheral side of a portion between the end of the second leg portion 73 and the coupling head portion 70.

The connecting portions 76 configured by a connecting thread for connecting between the adjacent elements 1012 by setting an interval between the first elements 1012 uniform to form the row of first elements 1012 is passed through an end (a base) at a left side (an L direction) of the first leg portion 72 and the second leg portion 73 respectively. The connecting portions 76 shown in FIG. 23 are integrally molded by insert molding when molding the row of first elements 1012.

In the embodiment shown in FIG. 23, although the separation portions 80 cut in a V shape is formed from a right side (an R direction) toward a left side (an L side) of the coupling head portions 70, the cut can be also formed from a left side (an L direction) toward a right side (an R direction) of the coupling head portions 70. The separation portions 80 can be also formed by reducing a cross-sectional area of the coupling head portions 70 by forming openings in the coupling head portions 70. One or plural separation portions 80 can be also formed in a range of the first fixing portion 84 to the second fixing portion 85, in addition to forming the separation portions 80 in the coupling head portions 70.

Element attaching portions of the first fastener stringer 1016 and the second fastener stringer 1017 shown in FIG. 24 have a U shape reversed toward a back surface side (a US direction). The row of first elements 1012 and the row of second elements 1013 are sewed by the fixing thread 215 to the element attaching portions of the fastener tapes 11 at left and right side reversed in a U shape.

The slide fastener shown in FIGS. 24 and 25 includes a conceal characteristic, but the invention is not limited to a concealed slide fastener.

The row of first elements 1012 and the row of second elements 1013 are sewed to the fastener tapes 11 by connecting the fixing thread 215 to the first fixing portion 84 (see FIG. 23) formed in the first leg portion 72 and to the second fixing portion 85 (see FIG. 23) formed in the second leg portion 73.

In the state shown in FIG. 24, when lateral pulling force equal to or larger than cleavage lateral pulling force is applied to the first fastener stringer 1016 and the second fastener stringer 1017 at left and right sides, tensile force is generated in the rupture portion 81, and the rupture portion 81 is ruptured. Then, the coupling head portion 70 of the second element 1013 passes through the separation portion 80 of the first element 1012, and is disengaged.

When the coupling head portion 70 of the second element 1013 is disengaged from the row of first elements 1012 at least at one position in the row of first elements 1012 and the row of second elements 1013 that are in the coupled state, the coupling between adjacent elements of the rows of elements is sequentially disengaged with relatively weak lateral pulling force, and the row of first elements 1012 and the row of second elements 1013 can be completely separated from each other. By suitably adjusting the cross-sectional area of the rupture portion 81 in this way, a range of cleavage lateral pulling force of the slide fastener can be set.

Polyacetal (POM), for example, can be used for a material of the row of first elements 1012 and the row of second elements 1013 shown in FIGS. 23 to 25. When polyacetal having tensile strength of 70 $N/mm^2$ is used for a material of the row of first elements 1012 and the row of second elements 1013, tensile rupture strength of the separation portion 80 of the first element 1012 can be set equal to or lower than 70 $N/mm^2 \times 0.57\ mm^2$=about 40 N, by setting a cross-sectional area of the rupture portion 81 equal to or smaller than 0.57 $mm^2$. As a result, cleavage lateral pulling force of the slide fastener can be set in a range of 240 N/inch to 500 N/inch (9.44 N/mm to 19.7 N/mm).

In the embodiment shown in FIG. 23 to FIG. 25, the separation portion 80 having weakened rupture strength is formed at a position in a range of the first fixing portion 84 of the first leg portion 72 to the second fixing portion 85 of the second leg portion 73 via the coupling head portion 70. With this arrangement, when the row of first elements 1012 and the row of second elements 1013 becomes in a separated state, inconvenience of occurrence of a rupture piece in the row of first elements 1012 or the row of second elements 1013 can be reduced. Cleavage lateral pulling force can be also reduced by forming a separation portion having a configuration of a part of elements in advance, instead of forming the separation portion 80 in a recessed shape by having reduced a cross-sectional area of the coupling head portion 70.

Figure 26:
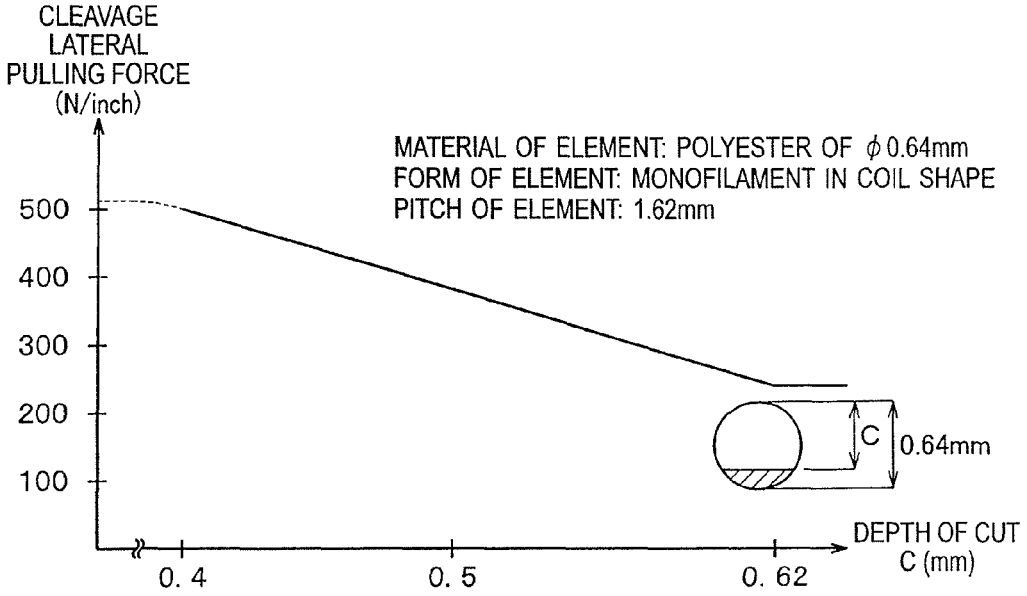
FIG. 26 shows an embodiment of a relationship between a depth C of a cut formed in a separation portion of monofilaments and cleavage lateral pulling force applied to a slide fastener.

FIG. 26 shows a relationship between a depth C of a cut formed in a separation portion of monofilaments and cleavage lateral pulling force applied to a slide fastener using the monofilaments. FIG. 26 shows a relationship between the depth C of a cut and the cleavage lateral pulling force when the monofilaments in a coil shape shown in FIG. 9 have a diameter D=0.64 mm, when a pitch is arranged at an interval of 1.62 mm, and when polyester having tensile strength 400 $N/mm^2$ is used for a material, for example.

As shown in FIG. 26, when a depth C of the cut is set equal to or larger than 0.4 mm in the monofilaments having a diameter D=0.64 mm, cleavage lateral pulling force reduces corresponding to the depth C of the cut. Therefore, by suitably setting the depth C of the cut, cleavage lateral pulling force can be set in a range of 240 N/inch to 500 N/inch (9.44 N/mm to 19.7 N/mm). When a diameter of monofilaments is D=0.64 mm and when a depth of the cut is C=0.4 mm, a cross-sectional area of the rupture portion is about 0.1 $mm^2$, and tensile rupture strength of the element (a monofilament) becomes 400 $N/mm^2 \times 0.1\ mm^2$=about 40 N. When a depth of the cut is C=0.5 mm, a cross-sectional area of the rupture portion is about 0.05 $mm^2$, and tensile rupture strength of the element (a monofilament) becomes 400 $N/mm^2 \times 0.05\ mm^2$=about 20 N.

INDUSTRIAL APPLICABILITY

The slide fastener according to the invention can be used for an expansion opening of an airbag, and can be also applied to an expansion opening of a lifejacket that is expanded by an expansion gas.

EXPLANATION OF REFERENCE NUMERALS

10, 110, 210, 310 Slide fastener
11 Fastener tape
12, 112, 212, 312, 412, 512, 612, 712, 1012 First element
13, 213, 313, 813, 913, 1013 Second element
14 Core portion
15, 215 Fixing thread
16, 116, 216, 316, 416, 516, 616, 716, 1016 First fastener stringer
17, 217, 317, 817, 1017 Second fastener stringer
59 Tab
70 Coupling head portion
72 First leg portion
73 Second leg portion
76 Connecting portion
80 Separation portion
81 Rupture portion
84 First fixing portion
85 Second fixing portion
91 Vehicle seat
92 Side airbag apparatus
93 Seat cushion
93*a* Seat cover
94 Seat back
94*a* Seat cover
C Depth of cut
D Diameter
d Small diameter

The invention claimed is:

1. A slide fastener, comprising:

a plurality of elements attached to opposite side edge portions of a first fastener tape and a second fastener tape to form a first fastener stringer and a second fastener stringer, wherein the elements of the first fastener stringer and the second fastener stringer are capable of being coupled and uncoupled via a slider, each of the elements has a first leg portion and a second leg portion that extend from a coupling head portion, and each of the elements has a first fixing portion and a second fixing portion where a fixing thread attaches each of the elements to its respective fastener tape, and, in at least the plurality of elements of the second fastener stringer, a separation portion in which a part of the first leg portion or the second leg portion is separated by a gap that extends completely through the element is formed in a range from the first fixing portion of the first leg portion to the second fixing portion of the second leg portion on a coupling head side of the element.

2. The slide fastener according to claim 1, wherein the range is from the first or second fixing portion to the coupling head portion.

3. The slide fastener according to claim 1, wherein the plurality of elements are in a continuous coil shape or zigzag shape, and are connected to each other via a connecting portion at ends of the first and second leg portions.

* * * * *

UNITED STATES PATENT AND TRADEMARK OFFICE

CERTIFICATE OF CORRECTION

PATENT NO. : 9,015,909 B2
APPLICATION NO. : 13/382540
DATED : April 28, 2015
INVENTOR(S) : Daijogo It is certified that error appears in the above-identified patent and that said Letters Patent is hereby corrected as shown below:

In the Specification

Column 1, line 2, insert -- This application is a national stage application of PCT/JP2009/062387, which is incorporated herein by reference. --.

Column 4, line 8, delete "of from" and insert -- from --, therefor.

Column 11, line 46, delete "9.44" and insert -- (9.44 --, therefor.

Signed and Sealed this
Twenty-ninth Day of September, 2015

Michelle K. Lee

Michelle K. Lee
*Director of the United States Patent and Trademark Office*